US012215464B2

(12) United States Patent
Paulson et al.

(10) Patent No.: US 12,215,464 B2
(45) Date of Patent: Feb. 4, 2025

(54) DISPERSIBLE NON-WOOD PULP

(71) Applicant: Kimberly-Clark Worldwide, Inc., Neenah, WI (US)

(72) Inventors: David J. Paulson, Appleton, WI (US); Thomas G. Shannon, Neenah, WI (US); Samantha C. Ackerly, Green Bay, WI (US); Richard L. Underhill, Neenah, WI (US); Zhiying Yu, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/251,940

(22) PCT Filed: Nov. 5, 2021

(86) PCT No.: PCT/US2021/058191

§ 371 (c)(1),
(2) Date: May 5, 2023

(87) PCT Pub. No.: WO2022/098958

PCT Pub. Date: May 12, 2022

(65) Prior Publication Data

US 2024/0003087 A1 Jan. 4, 2024

Related U.S. Application Data

(60) Provisional application No. 63/110,597, filed on Nov. 6, 2020.

(51) Int. Cl.

| | |
|---|---|
| ***D21H 11/12*** | (2006.01) |
| ***D21C 9/10*** | (2006.01) |
| ***D21C 9/16*** | (2006.01) |
| ***D21H 11/20*** | (2006.01) |

(52) U.S. Cl.

CPC ..... *D21H 11/12* (2013.01); *D21C 9/10* (2013.01); *D21C 9/16* (2013.01); *D21H 11/20* (2013.01)

(58) Field of Classification Search

CPC ..... D21H 11/12; D21H 11/20; D21H 27/002; D21H 27/005; D21C 3/02; D21C 9/16; D21C 1/06; D21C 9/007; D21C 9/163

See application file for complete search history.

(56) References Cited

U.S. PATENT DOCUMENTS

| | | | |
|---|---|---|---|
| 1,076,135 | A | 10/1913 | Frederick |
| 3,620,911 | A | 11/1971 | Eklund et al. |
| 5,320,710 | A | 6/1994 | Reeves et al. |
| 6,193,837 | B1 | 2/2001 | Agblevor et al. |
| 6,258,207 | B1 | 7/2001 | Pan |
| 6,302,997 | B1 | 10/2001 | Hurter et al. |
| 6,827,819 | B2 | 12/2004 | Dwiggins et al. |
| 6,896,768 | B2 | 5/2005 | Dwiggins et al. |
| 7,364,640 | B2 | 4/2008 | Chute et al. |
| 7,622,020 | B2 | 11/2009 | Awofeso et al. |
| 7,967,948 | B2 | 6/2011 | Nguyen |
| 8,029,645 | B2 | 10/2011 | Mohammadi |
| 8,080,130 | B2 | 12/2011 | Harper et al. |
| 8,426,031 | B2 | 4/2013 | Zwick et al. |
| 8,524,374 | B2 | 9/2013 | Shannon |
| 8,741,104 | B2 | 6/2014 | Edwards et al. |
| 8,795,469 | B2 | 8/2014 | Golfman |
| 10,132,036 | B2 | 11/2018 | Collins et al. |
| 10,145,069 | B2 | 12/2018 | Shannon et al. |
| 10,337,147 | B2 | 7/2019 | Rouse et al. |
| 10,337,148 | B2 | 7/2019 | Rouse et al. |
| 10,337,149 | B2 | 7/2019 | Rouse et al. |
| 10,570,261 | B2 | 2/2020 | Ziegenbein |
| 10,947,673 | B2 * | 3/2021 | Rouse ..... D21G 1/00 |
| 11,053,643 | B2 * | 7/2021 | Rouse ..... D21H 11/12 |
| 11,773,539 | B2 * | 10/2023 | Rouse ..... D21H 27/002 162/129 |

(Continued)

FOREIGN PATENT DOCUMENTS

| | | | |
|---|---|---|---|
| BR | 112015004673 | B1 | 6/2021 |
| CA | 2048333 | C | 5/1992 |

(Continued)

OTHER PUBLICATIONS

Reisinger, et al., "Understanding the Effect of Machine Technology and Cellulosic Fibers on Tissue Properties—A Review", bioresources.cnr.ncsu.edu, Oct. 19, 2019, https://bioresources.cnr.ncsu.edu/resources/understanding-the-effect-of-machine-technology-and-cellulosic-fibers-on-tissue-properties-a-review/.

Ghazali et al., "Alkaline Peroxide Mechanical Pulping (APMP) of Oil Palm Lignocellulosics: Part 2—Empty Fruit Bunch (EFB) Responses to Pretreatments", Informit, Oct. 19, 2019, https://search.informit.com.au/documentSummary;dn=586714406191367;res=IELENG.

Sanchez et al., "Chemical and thermogravimetric analysis and soda and organosolv pulping of Hesperaloe funifera", Cellulose Chemistry and Technology, Sep. 1, 2010, vol. 44, No. 9, pp. 327-334.

(Continued)

*Primary Examiner* — Jose A Fortuna

(74) *Attorney, Agent, or Firm* — KIMBERLY-CLARK WORLDWIDE, INC.

(57) ABSTRACT

Disclosed are non-wood pulps having a fiber length greater than about 1.70 mm and a Very Long Fiber (VLF) content of about 0.50% or less. The fibers are readily dispersible in water and useful in the formation of fibrous sheets, particularly wet-laid sheets and more particularly wet-laid tissue sheets having a relatively low basis weight. In addition of having a relatively long fiber length and a low VLF content, the pulps may also have a Dispersivity Index of about 2.00 or less, which is indicative of a relatively narrow fiber length distribution. The pulps may be prepared from plants of the family Asparagaceae by mechanical pulping and more preferably by a chemi-mechanical pulping process using an alkaline and hydrogen peroxide where the plant biomass is cut to size prior to pulping.

16 Claims, 4 Drawing Sheets

(56) References Cited

U.S. PATENT DOCUMENTS

| | | | | |
|---|---|---|---|---|
| 11,795,619 | B2 | 10/2023 | Wei et al. | |
| 12,098,507 | B2 * | 9/2024 | Shannon | D21H 11/20 |
| 12,146,262 | B2 * | 11/2024 | Yu | D21C 9/007 |
| 2004/0256065 | A1 | 12/2004 | Ahmed et al. | |
| 2010/0186912 | A1 | 7/2010 | Mauborgne et al. | |
| 2011/0061825 | A1 | 3/2011 | Li et al. | |
| 2014/0182801 | A1 | 7/2014 | Hawkins et al. | |
| 2014/0205777 | A1 | 7/2014 | Hawkins et al. | |
| 2015/0041085 | A1 | 2/2015 | Hawkins et al. | |
| 2015/0041087 | A1 | 2/2015 | Hawkins et al. | |
| 2015/0129143 | A1 | 5/2015 | Hawkins et al. | |
| 2018/0030654 | A1 | 2/2018 | Chute | |
| 2018/0134472 | A1 | 5/2018 | Shi et al. | |
| 2018/0135253 | A1 | 5/2018 | Shannon et al. | |
| 2018/0195239 | A1 | 7/2018 | Ziegenbein | |
| 2019/0264395 | A1 | 8/2019 | Rouse et al. | |
| 2019/0276985 | A1 | 9/2019 | Anderson et al. | |
| 2020/0102705 | A1 * | 4/2020 | Rouse | D21H 27/42 |
| 2020/0232166 | A1 * | 7/2020 | Rouse | D21F 11/04 |
| 2021/0156093 | A1 * | 5/2021 | Rouse | D21G 1/00 |
| 2021/0292973 | A1 * | 9/2021 | Rouse | D21F 11/04 |
| 2023/0320539 | A1 | 10/2023 | Young et al. | |
| 2023/0320540 | A1 | 10/2023 | Young et al. | |
| 2023/0320541 | A1 | 10/2023 | Young et al. | |
| 2023/0407562 | A1 * | 12/2023 | Shannon | D21C 9/007 |
| 2023/0407574 | A1 * | 12/2023 | Rouse | D21F 11/14 |
| 2024/0003087 | A1 * | 1/2024 | Paulson | D21C 9/16 |
| 2024/0011223 | A1 * | 1/2024 | Shannon | D21C 9/16 |
| 2024/0018723 | A1 * | 1/2024 | Yu | D21C 3/02 |
| 2024/0110336 | A1 * | 4/2024 | Young | D21H 27/002 |
| 2024/0209575 | A1 * | 6/2024 | Bailey | D21H 27/02 |

FOREIGN PATENT DOCUMENTS

| | | | | |
|---|---|---|---|---|
| CN | 1068866 | A | 2/1993 | |
| CN | 1920167 | A | 2/2007 | |
| CN | 101078186 | A | 11/2007 | |
| CN | 101105010 | A | 1/2008 | |
| CN | 101451313 | B | 1/2012 | |
| CN | 101451324 | B | 3/2013 | |
| CN | 106988139 | B | 9/2018 | |
| CN | 109653012 | A | 4/2019 | |
| CN | 110129380 | A | 8/2019 | |
| CN | 211311994 | U | 8/2020 | |
| EP | 2888401 | B1 | 1/2018 | |
| EP | 4335900 | A2 | 3/2024 | |
| JP | 3108559 | U | 4/2005 | |
| KR | 20160018586 | A | 2/2016 | |
| WO | 2005042830 | A1 | 5/2005 | |
| WO | 2005113865 | A1 | 12/2005 | |
| WO | 2007116473 | A1 | 10/2007 | |
| WO | 2009050338 | A1 | 4/2009 | |
| WO | 2013044347 | A1 | 4/2013 | |
| WO | 2014170753 | A1 | 10/2014 | |
| WO | 2018156109 | A1 | 8/2018 | |
| WO | WO-2022098956 | A1 * | 5/2022 | D21C 3/02 |
| WO | WO-2022098958 | A1 * | 5/2022 | D21C 3/02 |
| WO | WO-2022098962 | A1 * | 5/2022 | D21C 1/02 |
| WO | WO-2022098963 | A1 * | 5/2022 | D21C 1/02 |

OTHER PUBLICATIONS

Hurter et al., "Considerations for The Use of Nonwood Raw Materials for Tissue Manufacture", May 2016, https://www.researchgate.net/publication/301864513_Considerations_for_the_Use_of_Nonwood_Raw_Materials_for_Tissue_Manufacture.

Park et al., "Effect of pulp fibers on the surface softness component of hygiene paper", Nov. 15, 2019, https://www.degruyter.com/view/journals/hfsg/ahead-of-print/article-10.1515-hf-2019-0080/article-10.1515-hf-2019-0080.XML?language=de.

Kamoga et al., "A Review on Pulp Manufacture from Non Wood Plant Materials", Jun. 2013, International Journal of Chemical Engineering and Applications, http://www.ijcea.org/papers/281-110005.pdf.

Kim et al., "Effects of Kneading Treatment on the Properties of Various Pulp Fibers", Jun. 20, 2015, Journal of Korea Technical Association of The Pulp and Paper Industry, vol. 47, Issue 3, pp. 47-54, https://www.koreascience.or.kr/article/JAKO201521159149502.page.

* cited by examiner

DISPERSIBLE NON-WOOD PULP

BACKGROUND

Pulp is a lignocellulosic fibrous material prepared by chemically and/or mechanically separating cellulose fibers from wood, or non-wood fiber sources. Generally, the pulping process, whether by mechanical, chemical or a combination of mechanical and chemical, reduces the source material into its component fibers. In addition to separating the biomass into fibers, pulping removes a portion of the lignin from the fiber, while retaining the cellulosic and hemicellulosic portions. Chemical pulping achieves this by degrading the lignin into small, water-soluble molecules which can be washed away from the cellulose and hemicellulose fibers without depolymerizing them. Removal of lignin has the benefit of increasing the brightness of the pulp.

Fibers derived from woody biomasses often contain greater concentrations of lignin compared to non-wood biomasses. As such, processes for pulping woody biomasses, particularly processes for producing high brightness woody pulps, are often highly chemically intensive. The same processes, when applied to non-wood biomasses, often result in significant depolymerization of cellulose and hemicellulose causing excessively weak pulps. Thus, alternative pulping processes are often required to prepare non-wood pulps having sufficient strength and brightness.

While certain alternatives to the chemical intensive pulping processes have been developed for use in the manufacture of non-wood pulps, there remains a need in the art for processes that produce pulps having desirable properties such as relatively long fiber length, low coarseness, low degree of fines, good dispersibility and high brightness. This is particularly true for non-woods having leaves or stems containing an epidermal layer, which are challenging to pulp using conventional processes because of their non-fibrous nature.

SUMMARY

The present invention provides novel processes for pulping non-woods and novel pulps produced thereby. The non-wood pulps of the present invention have several beneficial properties such as relatively long fiber length, low coarseness, low degree of fines, good dispersibility, high brightness, or a low degree of debris. To achieve the beneficial properties the biomass is generally treated prior to pulping, mechanically pulped, and optionally bleached. In certain instances, the biomass is cut to size and a portion of the water soluble extractives are removed to produce a bagasse that may be subsequently mechanically pulped to produce a non-wood pulp according to the present invention.

Generally, the pulps are prepared by mechanical pulping and more preferably by a mechanical pulping process in which chemicals, such as alkaline and hydrogen peroxide, are added to the bagasse before or during one or more stages of mechanical refiner pulping. In those instances where the pulping chemicals comprise an oxygen based composition, such as hydrogen peroxide, stabilizers and may be applied to the bagasse before or during fibrillation in a refiner.

In certain embodiments, non-wood pulps of the present invention are prepared by a mechanical pulping process where at least one alkaline peroxide chemical addition occurs during, or immediately after, refining. The introduction of chemicals at, or downstream of, the refiner may be combined with the application of chemicals, particularly alkaline peroxide chemicals, to the bagasse before refining.

In a particularly preferred embodiment pulps of the present invention are prepared by preconditioning the bagasse with an alkaline peroxide solution followed by refining with further addition of an alkaline peroxide solution.

In particularly preferred embodiments, non-wood pulps of the present invention are prepared by a mechanical pulping process where at least one alkaline peroxide chemical addition occurs prior to refining, and another occurs during, or immediately after, refining. In a particularly preferred embodiment, the pulp is cleaned after refining to remove debris and a third alkaline peroxide chemical addition occurs to produce a bleached pulp. Preferably cleaning reduces the debris content of the pulp to about 5% or less, such as about 3% or less, prior to bleaching. Treatment of the pulp in this manner prior to bleaching may achieve, among other things, improved bleaching efficiency and/or increased brightness of the bleached pulp.

Accordingly, in one embodiment, the present invention provides a method of manufacturing a non-wood pulp comprising the steps of: (a) providing a non-wood biomass; (b) cutting the non-wood biomass to a nominal length; (c) extracting water soluble solids from the cut biomass to produce a bagasse; (d) impregnating the bagasse with a caustic solution and maintaining the impregnation for a first reaction time to produce impregnated bagasse; and (e) refining the impregnated bagasse under first refining conditions to produce pulp.

In another embodiment, the present invention provides a method of manufacturing a non-wood pulp comprising the steps of: (a) providing a non-wood biomass; (b) cutting the non-wood biomass to a nominal length less than about 20 mm; (c) extracting water soluble solids from the cut biomass; (d) pressing the extracted biomass to increase the consistency to at least about 40%; (e) impregnating the biomass with a first alkaline peroxide solution and maintaining the impregnation for a first reaction time to produce impregnated bagasse; (f) refining the impregnated bagasse under first refining conditions to produce a primary pulp; (g) cleaning the primary pulp; and (h) adding a second alkaline peroxide solution to the cleaned pulp to produce a bleached pulp.

In still other embodiments, the present invention provides a method of manufacturing a non-wood pulp comprising the steps of: (a) providing a non-wood biomass; (b) cutting the non-wood biomass to a nominal length; (c) extracting water soluble solids from the cut biomass; (d) impregnating the extracted biomass with a first alkaline peroxide solution and maintaining the impregnation for a first reaction time to produce an impregnated bagasse; (e) refining the impregnated bagasse under first refining conditions to produce a primary pulp; (f) cleaning the primary pulp to produce a cleaned pulp comprising less than about 5 wt %, by dry weight of the pulp, debris; and (g) adding a second alkaline peroxide solution to the cleaned pulp to produce a bleached pulp. Optionally the bleached pulp may be refined to produce a secondary pulp that may be useful in the manufacture of wet-laid paper products.

The pulps of the present invention are preferably prepared from a plant of the family Asparagaceae and have one or more physical properties that make them well suited for the manufacture of wet-laid fibrous products, such as tissue products. Accordingly, in certain embodiments, the invention provides a non-wood pulp comprising a plurality of fibers derived from a plant of the family Asparagaceae, the non-wood pulp having a fiber length greater than about 1.70 mm and a brightness of about 80% or greater, such as from about 80 to about 92%. In certain instances, the pulps are prepared from more plants of the genus *Hesperaloe*, particularly one or more plants selected from *H. funifera, H. parviflora, H. nocturna, H. chiangii, H. tenuifolia, H. engelmannii* and *H. malacophylla.*

In other embodiments the invention provides a non-wood pulp comprising fibers derived from a plant of the family Asparagaceae and having a fiber length greater than about 1.70 mm and a Very Long Fiber (VLF) content of about 0.50% or less.

In another embodiment, the present invention provides a non-wood pulp comprising a plurality of fibers derived from one or more plants selected from *H. funifera, H. parviflora, H. nocturna, H. chiangii, H. tenuifolia, H. engelmannii* and *H. malacophylla*, the pulp having a fiber length from about 1.70 to about 2.50 mm, a Dispersivity Index of about 2.00 or less and a coarseness from about 4.0 to about 10.0 mg/100 m.

In still other embodiments, the present invention provides a bleached, chemi-mechanical, non-wood pulp comprising a plurality of bleached, chemi-mechanical pulped fibers derived from one or more plants selected from *H. funifera, H. parviflora, H. nocturna, H. chiangii, H. tenuifolia, H. engelmannii* and *H. malacophylla*, the pulp having a fiber length from about 1.70 to about 2.50 mm, a Dispersivity Index of about 2.00 or less and a coarseness from about 4.0 to about 10.0 mg/100 m

DEFINITIONS

Figure 1:
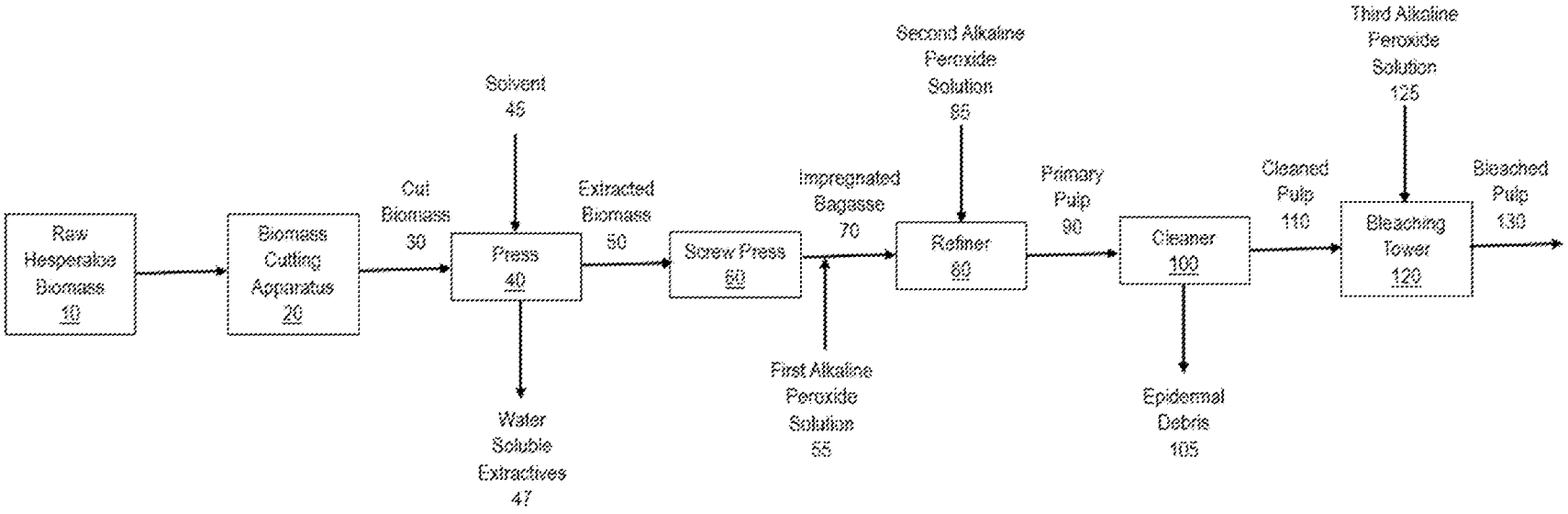
FIG. 1 is process flow diagram of a process for producing non-wood pulp according to one embodiment of the present invention.
Figure 2:
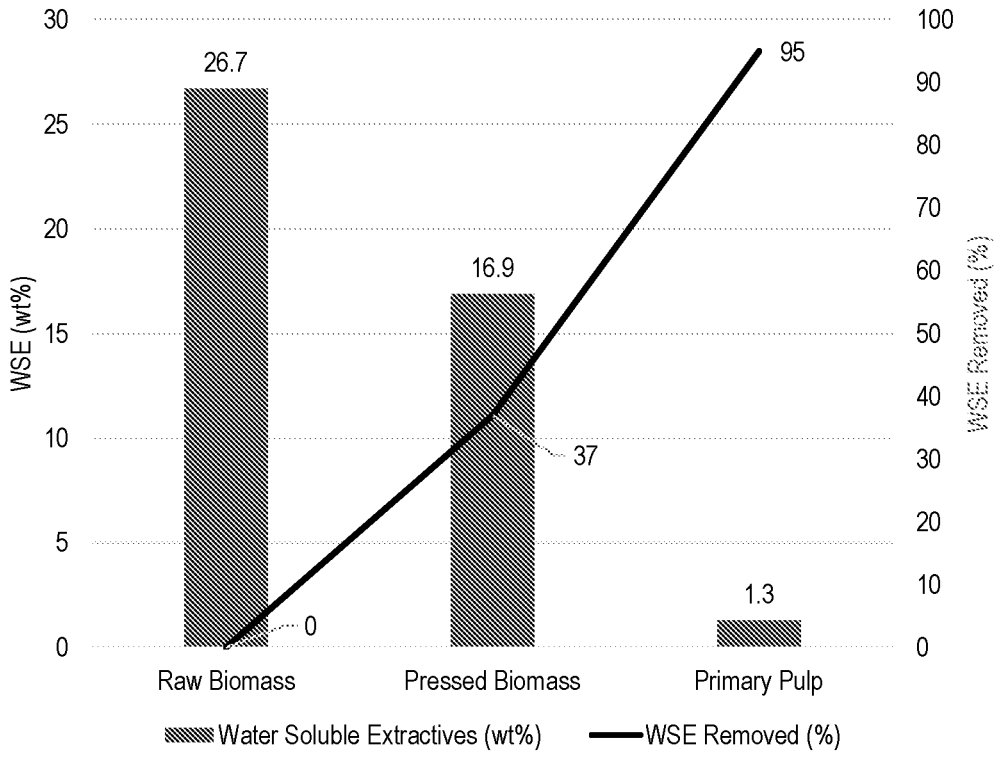
FIG. 2 is a plot illustrating the amount of water soluble extractive (WSE) removed during the pulp manufacturing process.

As used herein the term "Biomass" generally refers to organic matter derived from a non-woody plant and includes both whole plants and plant organs (i.e., leaves, stems, flowers, roots, etc.) derived.

As used herein, the term "Bagasse" generally refers to biomass that has been subjected to a processing step such as, for example, compression or maceration, to remove a portion of the biomass water soluble solids. In certain embodiments, bagasse is prepared by subjecting the biomass to compression and maceration using a plug screw or other form of compression screw to extract a portion of the biomass water soluble solids.

As used herein the term "Pulp" generally refers to a plurality of cellulosic fibers derived from biomass, the fibers having an elongate shape in which the apparent length exceeds the apparent width. Generally, pulps prepared according to the present invention are dispersible in water, have a measurable freeness, and may be used to form a handsheet.

As used herein, the term "Fines" generally refers to fibrous water insoluble cellulosic material having a length to width aspect ratio of from about 1 to about 100 and wherein the length of the fibrous water insoluble material is less than about 0.2 mm. In certain instances, pulp prepared according to the present invention may comprise fines. In certain embodiments, the amount of fines present in pulp prepared according to the present invention may be about 2.0% or less, such as about 1.5% or less, such as about 1.0% or less, such as from about 0.5 to about 2.0%. The fines content of pulp, on a length weighted basis, may be measured using an OpTest Fiber Quality Analyzer-360 (OpTest Equipment, Inc., Hawkesbury, ON) as described in the Test Methods section below. Generally, the percentage of fines on a length weighted basis is the sum of the fines length divided by the total length of fibers and fines in the sample.

As used herein, the term "Brightness" generally refers to the optical brightness of a pulp sample measured in accordance with ISO 2470-1:2016. Brightness is commonly expressed as a percentage (%).

As used herein, the term "Debris" generally refers to the weight percentage of solids retained on a MasterScreen™ apparatus fitted with a screen having a slot size of 100 μm (0.004 inches). The amount of debris in a given pulp sample is generally measured as set forth in the Test Methods section below.

As used herein, the term "Porosity" generally refers to the air permeability of a sample. Porosity is generally measured as described in the Test Methods section below and commonly has units of volume per unit area per unit time such as cubic feet per minute (cfm). For a given pulp sample, porosity is generally measured by dispersing the pulp in water to form a handsheet (as described in the Test Methods section below) and then measuring the porosity of the handsheet.

As used herein, the term "Tensile Index" generally refers to the tensile strength of a sample, having units of grams force per 25.4 mm, divided by the bone dry basis weight, having units of grams per square meter. For a given pulp sample, the tensile index is generally measured by dispersing the pulp in water to form a handsheet (as described in the Test Methods section below) and then measuring the tensile and basis weight of the handsheet.

As used herein, the term "Caliper" is the representative thickness of a pulp sheet and is generally measured as described in the Test Methods section below. Caliper commonly has units of millimeters or microns.

As used herein, the term "Freeness" refers to the Canadian Standard Freeness (CSF) determined in accordance with TAPPI Standard T 227 OM-94. Freeness commonly has units of milliliters (mL).

As used herein, the term "Fiber Length" generally refers to the length weighted average fiber length (LWAFL) of fibers measured using an OpTest Fiber Quality Analyzer, model FQA-360 (OpTest Equipment, Inc., Hawkesbury, ON) as described in the Test Methods section below. Fiber length commonly has units of millimeters.

As used herein, the term "Coarseness" generally refers to the weight per unit length of fiber measured using an OpTest Fiber Quality Analyzer-360 (OpTest Equipment, Inc., Hawkesbury, ON) as described in the Test Methods section below. Coarseness commonly has units of mass per unit length, such as milligrams per 100 meters (mg/100 meters).

As used herein, the term "Very Long Fiber Fraction" generally refers to the percentage of fibers having a length (number average fiber length) greater than 6.0 mm and is generally determined using an OpTest Fiber Quality Analyzer-360 (OpTest Equipment, Inc., Hawkesbury, ON) as described in the Test Methods section below.

As used herein, the term "Dispersivity Index" generally refers to the ratio of the length weighted average fiber length ($L_w$) to the number average fiber length ($L_n$). This ratio indicates the fiber length distribution of a given pulp. The length weighted average fiber length ($L_w$) to the number average fiber length ($L_n$) is generally determined using an OpTest Fiber Quality Analyzer-360 (OpTest Equipment, Inc., Hawkesbury, ON) as described in the Test Methods section below.

As used herein, the term "Nominal Size" when referring o the size of biomass or bagasse, generally refers to the size of a given screen through which at least about 70% of the biomass or bagasse passes through. Generally, a screen is a member capable of sieving material according to size. Examples of screens include a perforated plate, cylinder or the like, or a wire mesh or cloth fabric. The preferred method of screening and sizing bagasse and biomass is described in the Test Methods section below.

DESCRIPTION

This invention relates to pulp derived from non-woody plants and processes for preparing the same. In particularly preferred embodiments the present invention provides pulps having improved properties, such as high brightness, relatively long fiber length, low degree of fines, high porosity or low amounts of very long fibers that can inhibit dispersion of the pulp in water and cause stringing or clumping when the pulp is used to manufacture wet laid paper products.

Generally, the pulps of the present invention are prepared from one or more non-woody plants. Pulps may include fiber derived from a single plant species or alternatively, fibers that originate from two or more different plant species. Biomass useful in the present invention may comprise freshly harvested non-wood plants, partially dried non-wood plants, fully dried non-wood plants, or a combination thereof. The biomass may consist essentially of the above ground portion of the plant and more particularly the portion of the plant above the crown and still more preferable the leaves of the plant.

In certain preferred embodiments, pulps are prepared from one or more non-wood plants of the family Asparagaceae, Suitable non-wood plants may include, but are limited to, one or more plants of the genus *Agave* such as *A. tequilana, A. sisalana* and *A. fourcroyde*, and one or more plants of the genus *Hesperaloe* such as *H. funifera, H. parviflora, H. nocturna, H. chiangii, H. tenuifolia, H. engelmannii*, and *H. malacophylla*. In particularly preferred embodiments, the pulps of the present invention are prepared from one or more plants of the of the genus *Hesperaloe* such as *H. funifera, H. parviflora, H. nocturna, H. chiangii, H. tenuifolia, H. engelmannii*, and *H. malacophylla.*

Pulp may be produced from non-woody plants by processing biomass, particularly the non-seed portion of the plant, more particularly the leaves and still more particularly the leaves above the crown of the plant, extracting water soluble solids from the biomass to generate a bagasse, impregnating the bagasse with a chemical, and mechanically refining the impregnated bagasse to produce a primary pulp. The primary pulp may be subjected to further processing, such as screening and bleaching to yield a bleached pulp suitable for a wide variety of end uses. In certain instances, prior to refining, the water soluble solids may be removed from the non-wood biomass by compression and maceration. Compression and maceration may also be used to remove the epidermis from the biomass, as well as cut the biomass to size before refining.

In particularly preferred embodiments, pulps are prepared by a mechanical pulping process in which alkaline peroxide chemicals are added to the bagasse before or during one or more stages of mechanical refiner pulping. The hydrogen peroxide and alkali may be added in various forms, as will be disclosed in more detail below, together with various amounts of different peroxide stabilizers, and may be applied to the bagasse before or during fibrillation in a refiner. Suitable peroxide stabilizers include compounds that have the ability to form complexes with metals such as those disclosed in PCT Publication No. WO2005042830A1, the contents of which are incorporated herein in a manner consistent with the present invention. Particularly useful stabilizers include ethylenediaminetetraacetic acid (EDTA), diethylenetriaminepentaacetic acid (DTPA) and nitrilotriacetic acid (NTA). In other instances, silicates and sulfates may be suitable stabilizers. Stabilizers may be used alone, or in combination as needed.

In certain instances, pulp prepared according to the present invention may be bleached to increase its optical properties, particularly brightness. For example, in certain embodiments, the present invention provides non-wood pulp derived from plants of the genus *Hesperaloe* having a brightness of 75% or more, such as about 77% or more, such as about 79% or more, such as from about 75 to about 92%. Bleaching may be carried out using any one of the well-known pulp bleaching processes. In particularly preferred embodiments bleaching is carried out without the use of elemental chlorine and more preferably without the use of chlorine containing compounds. Bleaching may be carried out in a single stage or may be performed in multiple stages. In a particularly preferred embodiment, the bleaching process comprises at least one non-chlorine bleach stage although any one or more conventional non-chlorine bleaching stages or sequences can be used, including those with oxygen (including oxygen delignification), ozone, peroxide, hydrosulfite, and the like.

Although in certain embodiments it may be preferable to bleach the pulp to improve one or more optical properties the invention is not so limited and the pulps of the present invention may be unbleached and have a brightness less than about 75%, such as from about 50 to about 75%, such as from about 55 to about 70%.

The pulp products of the present invention are generally provided as a wet lap, or in dried form as sheets, bales or rolled forms and are distinguishable from other fibrous products such as those intended for use in packaging, tissue, books, magazine, letters, and the like. The caliper of a pulp sheet may range from about 0.05 to 0.50 cm, such as from about 0.10 to about 0.25 cm. The bone dry basis weight of pulp sheets prepared according to the present invention may range from about 200 to about 1,000 grams per square meter.

The pulp products of the present invention, while being produced from a non-wood fiber and produced by mechanical pulping, do not suffer the same freeness problems of prior art non-wood mechanical pulps. Indeed, in certain instances pulp products of the present invention have relatively high freeness, such as a Freeness of at least about 400 mL CSF, such as at least about 450 mL CSF, such as at least about 500 mL CSF, such as from about 400 to about 700 mL CSF, such as from about 450 to about 600 mL CSF. Generally, "freeness" refers to the drainage rate of pulp, or how "freely" the pulp will give up its water. Freeness is important in papermaking in that, if the freeness is too low, it is not possible to remove enough water on the paper machine to achieve good sheet structure and strength. Often, mechanical pulps, particularly mechanical non-wood pulps, have low freeness due to the high degree of fines that inhibit drainage of the pulp when wet-formed into a sheet.

The pulp products of the present invention are generally subjected to further processing to convert the fiber into a final product to be used by a consumer. For example, the pulp products may be provided in sheet form that may be dispersed in water with agitation, pumped to a headbox and wet-laid to form a fibrous web.

One non-limiting process for preparing pulps according to the present invention is illustrated in FIG. 1. The process generally comprises providing raw biomass 10 and cutting the biomass 10 to size using a cutting apparatus 20. As discussed in more detail below, cutting may be achieved by a variety of means and generally results in the cut biomass having a size of about 20 mm or less, such as at least about 10 mm or less. In addition to cutting, the biomass is preferably treated to extract a portion of the water soluble extractives prior to pulping. In certain instances, such as illustrated in FIG. 1, the cut biomass 30 may be passed through a press 40 while washing with an extraction solvent 45 to remove water soluble extractives 47 from the biomass 30. In certain instances, at least about 40% of the water soluble solids are removed from the biomass prior to pulping.

With continued reference to FIG. 1, the extracted biomass 50 is compressed using a screw press 60 and the compressed biomass is impregnated with a first alkaline peroxide solution 55 after exiting the screw press 60. The impregnated bagasse 70 is pulped using a refiner 80 with the addition of a second alkaline peroxide solution under first refining conditions to produce a primary pulp 90. In particularly preferred embodiments the first refining conditions are such that the primary pulp has a brightness of about 50% or greater. Thus, the first refining conditions may be selected to both fibrillate the biomass into pulp and to increase the brightness of the pulp. In this manner, the first refining conditions may be such that a primary bleaching of the pulp occurs at the refining stage. For example, the primary pulp may be refined under conditions that yield a primary pulp having a brightness of at least about 50%.

After refining, the primary pulp may be diluted and subjected to cleaning or screening to remove debris prior to the secondary bleaching. For example, as illustrated in FIG. 1, epidermal debris 105 may be removed from the primary pulp 90 by passing the pulp through a cleaner 100. The cleaned primary pulp 110 may then be transferred to a bleaching tower 120 and bleached by adding a third alkaline peroxide solution 125 to produce a bleached pulp 130.

Generally, it is preferable to cut the biomass to size prior to processing the biomass, such as extracting, pressing, milling, or pulping. In certain instances, the biomass may be cut to size and cleaned immediately prior to milling and extraction to remove the water soluble fraction of the biomass. In other embodiments the biomass may be cut to size when harvested by using harvesting equipment designed to produce biomass chips of a desired size, particularly equipment designed to cut and chip biomass in a single operation.

In a specific embodiment, the biomass may be cut to size at the time of harvesting using a forage harvester. A forage harvester typically comprises a header and a cutter wheel or drum. In a preferred embodiment, the biomass is cut directly by the harvester header, using reciprocating knives, discs or rotary mowers or large saw-like blades. The header is configured such that the cut height is above the crown of the plant such as from about 10 to about 30 cm above the ground. From the header the biomass is fed to the cutter wheel. The cutter wheel is equipped with several knives fixed to it that chop and blow the silage out a chute of the harvester into a wagon that is either connected to the harvester or to another vehicle driving alongside. The configuration of the knives, the number of knives attached to the cutter wheel and the speed of the cutter wheel determines the cut size of the biomass. In one embodiment, the biomass size is selected such that the nominal chop length is from 5 to about 50 mm, such as from 5 to about 30 mm, such as from about 5 to about 20 mm. It should be noted that the nominal chop length is set by the harvester and the actual chop length of the material may vary depending upon the consistency of orientation of the biomass feeding into the cutter wheel as well as other factors.

In other instances, the biomass may be cut to size after harvesting using a mechanical size reduction process such as a hammer mill, rotary shredder, shear shredder, knife hog, tub grinder, woodchipper, or any other device that reduces the nominal size of the entering biomass. In a particularly preferred embodiment, the biomass is cut to size using a hammermill. For example, the harvested biomass may be modified into a format that can be handled more easily by the hammermill operation using such things as tub grinders, horizontal grinders/shredders, or simple woodchippers. These first stage systems typically have large rotating drums with large blunt hammers that quickly shear or shred the material into a less dense, loose format that can be easily milled to the desired size. Large screens are generally used in first-stage grinding to prevent oversized material from exiting the grinding chamber. These screens may have openings that range in size from about 5 to about 15 cm. Chippers typically use rotating drums with fixed knives parallel to the drum axis. The size of the cut biomass is generally controlled by feed rate. Once the first-stage grinding or chipping is completed, the feedstock is milled to the desired particle size using a hammermill. Hammermills use large rotating drums with protruding metal bars (i.e., hammers) that impact the material at high velocity to shatter and tear material particles. Typically, the metal bars swing freely from the drum, but fixed hammers are also common in hammer mill designs. The size of biomass exiting the hammermill may range from 5 to about 50 mm, such as from 5 to about 30 mm, such as from about 5 to about 20 mm.

Generally cutting the biomass, particularly before the biomass is pulped or bleached, improves one or more physical properties of the resulting pulp. For example, cutting the biomass may reduce the fraction of long fibers in the pulp making the pulp more readily dispersible and amenable for use in the manufacture of wet-laid paper products, particularly wet-laid tissue products. In certain instances, the reduction in long fiber fraction may be achieved without a significant reduction in the fiber length, such that the pulp may have a fiber length of about 1.75 mm or greater, such as about 1.80 mm or greater, such as about 2.0 mm or greater, such as from about 1.75 to about 2.50 mm. The effect of cutting on the amount of fibers falling within certain ranges of fiber lengths is shown in Table 1, below.

TABLE 1

| Description of Pulp | Very Long Fiber (%) | Fiber Length 3-6 mm (%) |
|---|---|---|
| Uncut | 0.8 | 17.55 |
| Cut to size with mechanical chipper | 0.08 | 5.73 |
| Cut to size with harvester | 0.05 | 3.52 |
| Northern Softwood Kraft Pulp | 0.01 | 8.09 |

Cutting biomass prior to pulping may also reduce the fraction of pulp fibers having a very long fiber length, that is the fraction of pulp fibers having a fiber length of 6.0 mm or greater. For example, pulps prepared according to the present invention may comprise less than about 0.50% very long fiber, more preferably less than about 0.25% very long fiber, more preferably less than about 0.20%, and still more preferably less than about 0.15%. A comparison of the very long fiber fraction of pulps prepared by cutting *Hesperaloe* biomass according to the present invention compared to pulps prepared without cutting the *Hesperaloe* biomass are shown in Table 2, below.

TABLE 2

| Pulping Process | Alkaline peroxide mechanic pulping | Alkaline peroxide mechanic pulping | Alkaline peroxide mechanic pulping | Alkaline peroxide mechanic pulping | Mechanical | Acid catalyzed hydrolysis with agitation |
|---|---|---|---|---|---|---|
| Bleached | Yes | Yes | Yes | Yes | No | No |
| Cut | Yes | Yes | No | No | No | No |
| Brightness (%) | — | 82 | 78 | — | — | 55 |
| Freeness (mL) | 576 | 604 | — | 529 | 170 | 512 |
| Fiber Length (mm) | 2.09 | 1.75 | 2.73 | 2.73 | 1.73 | 1.45 |
| Coarseness (mg/100 m) | 5.5 | 4.5 | NA | — | — | 5.1 |
| Weight Average Fines | 0.8 | 1.3 | 0.9 | 1.1 | 4.6 | 4.3 |
| Very Long Fiber (%) | 0.08 | 0.05 | 0.56 | 0.54 | 0.09 | 0.01 |

In still other instances cutting the biomass prior to pulping reduces, or narrows, the distribution of fiber lengths such that the dispersivity index is about 2.00 or less, more preferably about 1.90 or less, still more preferably about 1.85 or less, such as from about 1.50 to about 2.00, such as from about 1.50 to about 1.90, such as from about 1.50 to about 1.85, such as from about 1.50 to about 1.80. In particularly preferred embodiments pulps of the present invention have a dispersivity index less than about 1.80 to ensure that the length of the fibers is relatively uniform, improving dispersing the pulp in water, and reducing fiber clumping and stringing when forming wet-laid paper products.

While cutting the fibers generally reduces the dispersivity index and the very long fiber fraction of the pulp, pulps of the present invention may have a relatively low degree of fines. For example, in certain embodiments, pulps prepared according to the present invention may comprise less than about 2.0% fines, such as less than about 1.5% fines, such as less than about 1.0% fines, such as from about 0.10 to about 2.0% fines. Generally, the low degrees of fines enable water to readily drain from the pulp, such that pulps of the present invention have a Canadian Standard Freeness (CSF) greater than about 400 mL, and more preferably greater than about 450 mL, such as from about 400 to about 600 mL.

The biomass, cut or uncut, is preferably extracted to remove a portion of the water soluble solids prior to pulping. Removal of the water soluble solids may be carried out using any one of a number of suitable extraction processes. In a particularly preferred embodiment, extraction is carried out using one or more solvents, particularly an aqueous solvent and more particularly an aqueous polar solvent such as water. One of skill in the art will recognize the ratio of extraction solvent to biomass will vary based on the solvent, the amount of biomass to be extracted, and the extraction procedure. In certain preferred embodiments, the extraction solvent is water and the ratio of extraction solvent to biomass, on the basis of liters of extraction solvent to kilogram of bone-dry biomass, is from about 1:5 to about 1:100, such as from about 1:5 to about 1:50 and more preferably from about 1:5 to about 1:20.

The pH of the extraction solvent can be between about pH 5.0 and 8.0, such as, for example, between about pH 6.0 and about 8.0, between about pH 6.5 and about 7.5. In a particular embodiment, the extraction solvent is water having a pH between about pH 6.5 and about 7.5. In those embodiments where extraction includes imbibition with a crude juice, the imbibition fluid may have a pH from about 4.0 to about 5.0.

In embodiments where the extraction process is a batch extraction process, the duration of extraction may range from about 0.25 to about 24 hours, such as, for example, from about 0.5 to about 2 hours, from about 1 to about 8 hours, or from about 1 to about 6 hours.

In embodiments where the extraction process is a continuous process, the duration of extraction may range from about 0.25 to about 5 hours, such as, for example, from about 0.5 to about 3 hours.

For the purpose of preparing the compositions of the present invention, and for use in the present method, a simple aqueous extract may be preferred, although other extraction methods are within the scope of the present invention. For example, a simple water extraction of biomass may be suitable for achieving an insoluble biomass fraction, referred to herein as bagasse, that may be further processed according to the present invention. In other instances, the extractant solution may comprise, in addition to water, a surfactant, an additional solvent or extract-bearing juice. The extract-bearing juice can come from, for example, an earlier extraction step or an earlier milling step.

In certain embodiments, it may be preferred to combine extraction with milling of the biomass. The biomass may be milled using a roll, screw, and other forms of presses. In certain preferred embodiments, biomass is passed between one or more nips of opposed counter-rotating rolls to maximize the mechanical removal of the water soluble fraction and production of a bagasse that may be subjected to further processing as described below. In those embodiments where the bagasse is subjected to multiple pressings, the water soluble fraction removed in one milling step, commonly referred to as juice, may be used to wash the bagasse in a subsequent milling step.

In a particularly preferred embodiment, biomass may be cut to size, milled and extracted with an aqueous solvent to remove water soluble extracts such as inorganic salts, saccharides, polysaccharides, organic acids and saponins. In a particularly preferred embodiment, water soluble solids are removed from biomass, particularly leaves, prior to pulping by a series of mills, such as two, three, four, five, six or seven mills arranged in tandem, optionally with imbibition. Generally, the extraction step, alone or in combination with milling, removes at least about 25% of the water soluble solids from the biomass, more preferably at least about 50%, still more preferably at least about 75%, such as from about 25 to about 98%, such as from about 50 to about 90%, such as from about 75 to about 90%.

Figure 3:
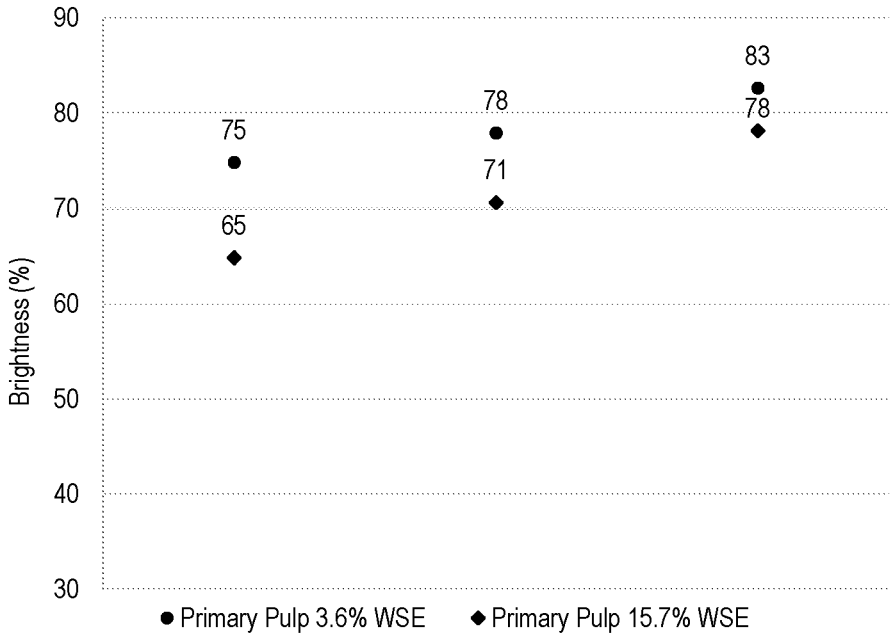
FIG. 3 is a plot illustrating the effect of water soluble extractive (WSE) on pulp brightness, the brightness of pulps having different degrees of WSE were measured after first, second and third stages of bleaching.
Figure 4:
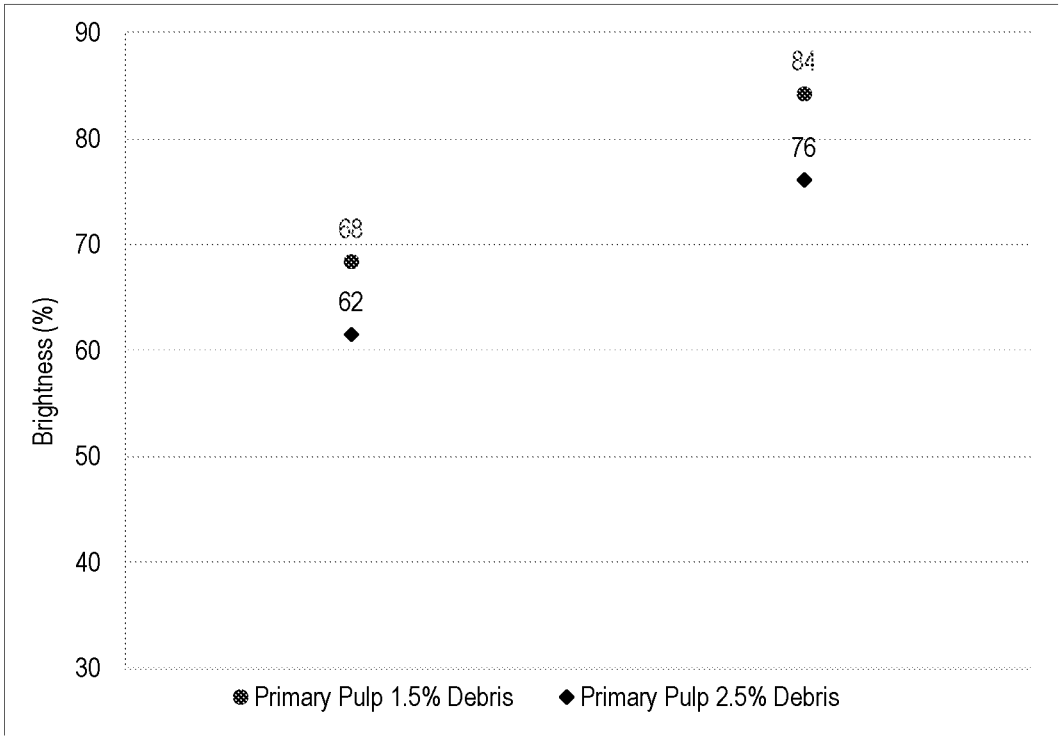
FIG. 4 is a plot illustrating the effect of debris on pulp brightness, the brightness of pulps having different degrees of debris were measured after first and second stages of bleaching.
Figure 5:
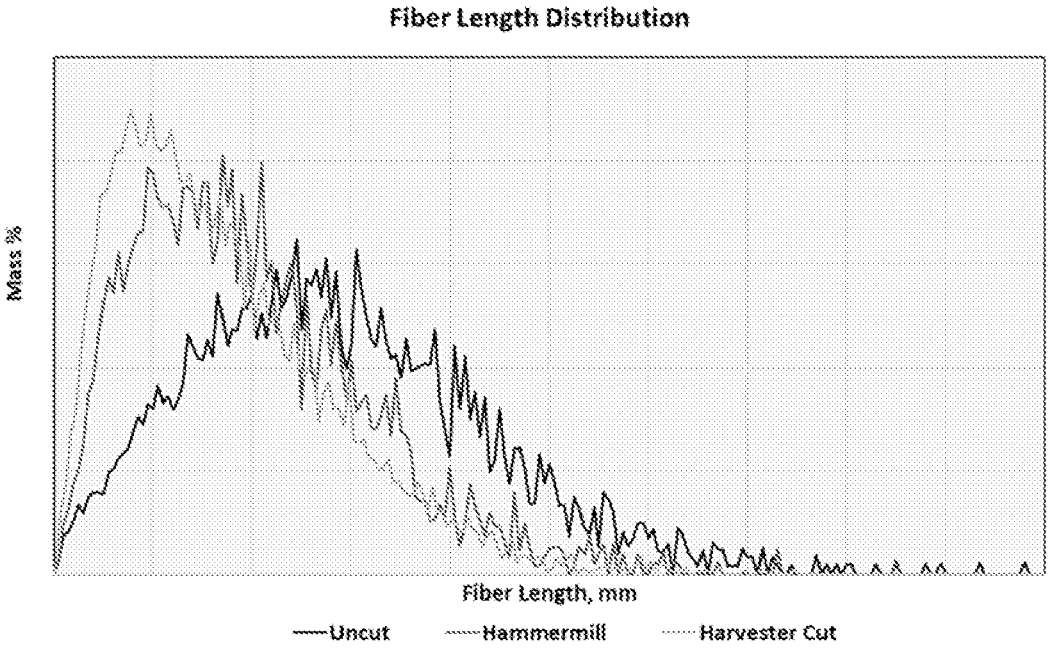
FIG. 5 illustrates the effect of cutting the biomass prior to pulping on the distribution of fiber lengths.

Removal of water soluble extractives from the biomass is preferably carried out prior to pulping and more preferably prior to bleaching. Removal of water soluble extractives from the biomass may improve the efficiency of pulping and/or bleaching. For example, it has been demonstrated that removal of a significant portion of its water soluble extractives from the primary pulp, such as at least about 85% and still more preferably at least about 90% of the water soluble extractives, improves the brightness of the bleached pulp. In certain instances, the present invention provides removing at least 85% of the water soluble extractives from the pulp prior to bleaching, such as at least about 90%, such as at least about 95%. By removing the water soluble extractives prior to bleaching, the bleached pulps may have a brightness of about 80% or greater. An illustration of the effect of water soluble extractives on bleaching and the resulting brightness of the pulp is shown in FIG. 3.

In other embodiments, the water soluble solids may be removed from biomass prior to pulping by diffusion. In diffusion, the biomass is brought into contact with a solvent to extract the water soluble solids. Usually, the biomass is prepared by first cutting, but not shearing or crushing, so as to minimize the damage to fibers, and avoid the creation of an excessive amount of fines. The prepared biomass is then washed repeatedly with a solvent in a diffuser to extract water soluble solids from the biomass. The solvent can be any of the foregoing solvents. An exemplary solvent is water, particularly hot water, more particularly water having a temperature from about 40 to about 90° C.

Various types of diffusers are known in the art and can be adapted for use with biomass as described herein. Suitable diffusers include a ring diffuser, a tower diffuser, or a drum diffuser. Exemplary diffusion systems are discussed, for example, in U.S. Pat. Nos. 4,182,632, 4,751,060, 5,885,539 and 6,193,805 the contents of which are hereby incorporated in a manner consistent with the present disclosure. Numerous other diffusion methods and devices for the diffusion method are known and can be adapted for use in the methods described herein. One such diffuser is the continuous-loop, counter-current, shallow-bed Crown Model III Percolation Extractor, commercially available from Crown Iron Works, Blaine, MN.

In still other embodiments, the water soluble fraction of the biomass may be removed prior to pulping by compression and maceration. Compression and maceration may be carried out using multiple devices or a single compression and macerating device such as a plug screw feeder, for example an MSD Impressafiner® commercially available from Andritz, Inc. of Alpharetta, GA, or other device suitable to both compress and macerate the cut and washed biomass. For example, the cut biomass may be compressed by a device capable of at least a 2.5 to 1 compression ratio, such as a 4 to 1 compression ratio, such as a 5 to 1 compression ratio (including all compression ratios in between) to remove the water soluble fraction and prepare the biomass for pulping. The compression ratio is defined as inlet volume of the compression zone related to the outlet volume of the compression zone. Such a compression ratio allows sufficient pressurization on the biomass to ensure proper chemical absorption during pulping.

The device used for compression may be further used for maceration or a separate device may be used for the maceration phase. Maceration allows the softening and separation of biomass into fibers by the application of physical mechanical treatment. Maceration may also increase the surface area of bagasse available to absorb chemicals during subsequent pulping steps.

The extracted bagasse is converted to pulp by mechanical refining with, or without, the addition of chemicals such as alkaline based chemicals. In certain embodiments it may be preferred to add chemicals after the extracted bagasse has been macerated to form fibers but is still in a state of compression. Once the chemicals have been introduced, compression forces may be released allowing the chemicals to be pulled into the cells of the macerated fibers, thereby forming the compressed, macerated, and impregnated bagasse. By introducing chemicals only after maceration and while under compression, the volume of chemical absorbed by the washed and dewatered lignocellulosic material is greater than in known processes where chemicals are added after compression alone or after maceration alone.

In certain embodiments, pulping is carried out using an alkaline peroxide mechanical pulping (APMP) process as is known in the art. Suitable APMP processes are described, for example, in U.S. Pat. Nos. 4,270,976 and 8,048,263, the contents of which are incorporated herein by reference in a manner consistent with the present invention. Generally, the APMP process comprises the addition of hydrogen peroxide and alkali in various forms, together with various amounts of different peroxide stabilizers, to the bagasse before or during fibrillation in a refiner.

In a particularly preferred embodiment, the bagasse is impregnated by a first alkaline peroxide solution. Impregnation is preferably carried out in a compression and maceration device for a first reaction time. Impregnated bagasse is then fed to a digester having an inlet and a rotating disc within a casing. A second alkaline peroxide solution is added to the impregnated bagasse as it is fed into the digester. The second alkaline peroxide solution and impregnated bagasse are mixed in the digester by a rotating disc within the digester casing for a second reaction time to refine the impregnated bagasse to a primary pulp.

The digester step may operate in continuous or batch mode. If continuous mode is used, a single digester or multiple digesters in series or parallel may be operated. If batch mode is used, multiple digesters operating alternately so as to accommodate continuous transfer of impregnated bagasse to the digester and continuous feed of primary pulp from the digester.

The digester may be operated at temperatures from about 120 to about 190° C. The digester may be horizontal, vertical, or inclined orientation. Additionally, the digester may operate in concurrent or countercurrent, or a combination of concurrent and countercurrent mode. In this context, concurrent flow within the digester means flow of biomass is in the same direction as any added alkaline peroxide solution. Also, the digester may be operated at high or low consistency. In particularly preferred embodiments the digester vessel is operated at a high consistency such as a consistency of at least about 20%, such as at least about 30%, such as from about 35 to about 45%. In those embodiments where the digester vessel is operated at a high consistency the liquor to biomass ratio may be in the range from about 2.0 to about 5.0.

The primary pulp may be discharged from the digester under conditions that allow continued reaction between the alkaline peroxide chemicals and the primary pulp. In this manner, the primary pulp may be subjected to a first stage of bleaching at a relatively high consistency before being diluted to facilitate cleaning before a secondary bleaching. For example, the primary pulp may be maintained at a consistency of at least about 20%, such as at least about 30%, such as from about 35 to about 45% and reacted with the alkaline peroxide chemicals to produce a primary pulp having a brightness from about to about 60%. The primary pulp may then be diluted, cleaned to remove debris, and subjected to additional bleaching to produce a bleached pulp having a brightness of about 80% or greater, such as from about 80 to about 92%, such as from about 80 to about 90%, such as from about 80 to about 85%.

In certain instances, to allow continued reaction between the alkaline peroxide chemicals and the primary pulp, conditions of temperature may be maintained during discharge of the primary pulp by using a mixing screw with water added while the primary pulp is mixed and transferred to the bleaching tower for secondary bleaching. The temperature of the primary pulp may also be thermally adjusted within the bleaching tower with the addition of liquids or gases or through use of heat transfer components if the primary pulp is discharged directly to the bleaching tower.

In certain instances, the primary pulp may be transferred from the digester to the bleaching tower under atmospheric conditions by a transfer screw, a chute, or the like. Where the digester comprises a pressurized casing, the primary pulp may be discharged to the bleaching tower via a blow valve.

The digester conditions may be maintained such that the primary pulp has a temperature greater than about 80° C. and still more preferably greater than about 85° C. and pH greater than about 8.5 and more preferably greater than about 9.0 and still more preferably greater than about 9.5 prior to being discharged to the bleaching tower. Once the primary pulp is discharged the pulp may be quenched, such as by cooling. For example, the primary pulp may be cooled to less than about 80° C. as it transferred to, or received by, the bleaching tower.

Generally, the primary pulp is subjected to additional bleaching in a secondary bleaching stage. Secondary bleaching is preferably carried out without the use of chlorine or chlorine containing compounds. More preferably, secondary bleaching is carried out using a non-chlorine oxidizing agent, such as peroxides, oxygen, and/or ozone with the addition of cyanamide or cyanamide salt. When secondary bleaching includes a peroxide as a bleaching agent, the process may also include one or more stabilizers or complex former to avoid decomposition of the peroxide. The addition of the stabilizer or complex former can be omitted if the heavy metal salts from the primary pulp are removed by washing prior to bleaching.

In certain embodiments, it may be desirable to separate epidermal debris from the primary pulp prior to secondary bleaching. Epidermal debris generally originates from the cuticle of biomass leaves and may include additional layers of cellulosic epidermis. Epidermal debris may comprise cellulose, cutin, cutan, polysaccharides, lipids and waxes. Epidermal debris may be hydrophobic and may have a color or hand feel that is undesirable in paper products. For example, the epidermal debris may have a brown or yellow color and a coarse hand feel.

Removal of epidermal debris prior to secondary bleaching may improve secondary bleaching efficiency and increase the brightness of the finished pulp. Additionally, removal of epidermal debris may improve the physical properties of paper products made with the pulp. For example, removal of epidermal debris from the pulp may improve the hand feel and softness of tissue products made therefrom. In other instances, removal of epidermal debris from the pulp may reduce the amount of linting in the finished product as the often hydrophobic debris is not well suited for bonding with cellulosic fibers forming the paper product.

In certain embodiments it may be preferable for the debris content of the primary pulp to be about 5 wt % or less, such as about 3 wt % or less, such as less than about 2.5 wt % prior to secondary bleaching, such as less than about 2.0 wt %. Preferably the primary pulp has low debris content and as such there is generally no specific lower limit on the amount of debris. In certain instances, however, a certain amount of epidermal debris may survive processing and the primary pulp may have a debris content of about 0.5 wt % or greater, such as from about 1.0 to about 5.0 wt %.

By reducing the debris prior to secondary bleaching, the resulting bleached pulp may have improved brightness and an acceptable level of debris. Such pulps are well suited for producing high brightness paper products, particularly tissue products that require a high degree of brightness and low lint. Accordingly, in certain preferred embodiments, bleached pulps of the present invention have a Brightness of at least about 80% and a debris content of about 1.0 wt % or less, such as about 0.90 wt % or less, such as about 0.80 wt % or less, such as about 0.60 wt % or less. In certain instances, it may be desirable to remove substantially all of the debris from the pulp prior to bleaching such that the bleached pulp has no detectable debris.

Non-limiting examples of devices useful for removing epidermal debris from primary pulp include one or more screens, cleaners, washers, or surge tanks. In certain instances, debris may be removed using a screen, particularly a pressure screen having a body equipped with a first screen having slots and a second screen having holes so that both slots and holes may be used to screen the primary pulp. Multiple screens may be used in a number of different configurations and flows.

In a particularly preferred embodiment, debris is removed from primary pulp by screening the pulp using a pressure screen having at least one slot. The slots may have a width dimension of about mm or less, such as about 0.25 mm or less, such as from about 0.10 to about 0.15 mm.

Debris may also be removed from the primary pulp by one or more conical cleaners, particularly one or more hydrocyclones. One skilled in the art will recognize that hydrocyclone is a generic description of cleaning equipment that uses centrifugal force, and other hydrodynamic forces, to separate insoluble solids based upon density. Generally, the conical cleaner has a geometry that provides decreasing (cross-sectional) diameter. Multiple cleaners may be combined in a variety of orientations so as to share common feed and discharge chambers.

The conical cleaners may include one or more of a forward flow (conventional) cleaner; a low density cleaner, a reverse cleaner, a through flow cleaner, a core bleed cleaner, an asymmetrical cleaner, and a rotating body cleaner. In a particularly preferred embodiment, epidermal debris is removed from the primary pulp by at least one low density cleaner having a diameter from about 25 to about 120 cm, and an operated pressure drop from about 100 to about 210 kPa. The low density cleaner may be operated in a forward feed configuration and at a pulp consistency from about 0.5 to about 2.0%.

After cleaning, the cleaned pulp may be subjected to secondary bleaching. Secondary bleaching may be carried out at a medium or high consistency and may consist of one, two or three stages of bleaching depending on the desired brightness of the finished pulp. Generally, medium consistency bleaching is carried out at a pulp consistency less than about 16%, such as from about 8% to about 16%, such as from about 8 to about 12%. High consistency bleaching, on the other-hand, may be carried out at a pulp consistency of about 16%, such as from about 16 to about 30%, such as from about 16 to about 22%.

In certain preferred embodiments, secondary bleaching may be carried out in two stages at a consistency of about 10% with alkaline peroxide solution with or without the peroxide stabilizers: sodium silicate and the sodium salt of diethylene-triamine-penta-acetic acid (DTPA). In other embodiments, secondary bleaching may be carried out in two stages where the first stage is carried out at a consistency of about 20% and the second stage is carried out at a consistency of about 10% and both stages are performed using an alkaline peroxide solution with or without the peroxide stabilizers: sodium silicate and DTPA. In still other embodiments secondary bleaching may be carried out in a single high consistency stage, such as at a consistency of about 20%. Regardless of the number of stages or the consistency of the pulp, the overall peroxide dosage may range from about 8 to about 12% and the caustic to peroxide ratio may range from about 0.4 to about 0.6.

Secondary bleaching may be carried out a temperature from about 80° C. to about 85° C. and the total retention time may range from about 1 to about 5 hours. The final pH of the bleached pulp may be from about 9 to about 11, more preferably from about 9 to about 10.

The bleached pulp may be fed to a further processing step, which may involve multiple operations including, but not limited to, mechanical refining, screening, and washing to produce a secondary bleached pulp suitable for final use, such as the manufacture of wet-laid paper products. For example, in one embodiment, the bleached pulp may be diluted and refined at a low consistency, such as a consistency from about 3.0 to about 5.0% using a twin-flow, non-pressurized, refiner. The refined bleached pulp may then be dewatered, dried, and formed into sheets.

As an option, pulps, both bleached and unbleached, prepared according to the present invention may be formed into dried sheets or rolls. The pulp may be diluted with water resulting in diluted pulp that can be pumped via a fan pump to a headbox. The diluted pulp can be supplied to the headbox at consistencies ranging from about 0.1 to about 5% solids, such as from about 0.5 to about 3% solids, such as from about 1 to about 2.5% by weight solids.

From the headbox the diluted pulp can be sprayed onto a wire and partially dewatered to form a partially dewatered pulp sheet. The wire may be a foraminous continuous metal screen or plastic mesh which travels in a loop. The wire can be, for example, a flat wire Fourdrinier, a twin wire former, or any combinations of these. Low vacuum boxes and suction boxes may be used with the wire in conventional manners. The consistency of the pulp sheet after dewatering on the wire may range from about 2 to about 35% solids, such as from about 10 to about 30% solids.

The partially dewatered pulp sheet may be conveyed to a wet-press section. Additional water can be pressed and vacuumed from the pulp at the wet-press section. The wet-press section can remove water from the pulp with a system of nips formed by rolls pressing against each other aided by press felts that support the pulp sheet and can absorb the pressed water. A vacuum box may optionally be used to apply vacuum to the press felt to remove the moisture so that when the felt returns to the nip on the next cycle, it does not add moisture to the sheet. The wet-press section may increase the consistency of the partially dewatered pulp sheet to about 40% solids or greater, such as about 50% solids or greater.

The pressed pulp may be dried by a thermal dryer section. The pulp sheet can be dried in the thermal dryer section at a temperature in excess of 100° C. to remove more water. The thermal dryer may comprise, for example, a series of internally steam-heated cylinders that evaporate the moisture of the pulp as the pulp is advanced over the heated cylinders. Generally, the thermal driers increase the consistency of the pressed pulp to about 80% or greater, such as about 90% or greater, such as from about 80 to about 95% by weight.

The dried pulp exiting the thermal dryer may be in the form of a continuous dried pulp sheet, which may be unitized into sheets, bales, rolls or other forms. In certain embodiments the resulting pulp sheet has a moisture content of less than about 30 percent, more preferably less than 20 percent and still more preferably less than about 10 percent. Pulp sheets may be produced at any given basis weight, however, in certain embodiments the pulp sheets may have a basis weight of at least about 150 grams per square meter (gsm), such as from about 150 to about 600 gsm and more preferably from about 200 to about 500 gsm.

The ability of the pulp sheet to disperse in water and drain during sheet formation is quite important since, if sufficient drainage does not take place, the speed of the paper machine must be reduced, or the wet-formed web will not hold together on the foraminous surface. A measure of this drainage parameter is freeness, and more particularly Canadian Standard Freeness (CSF). Accordingly, in certain embodiments pulps prepared according to the present disclosure have a Canadian Standard Freeness (CSF) greater than about 400 mL, and more preferably greater than about 450 mL, such as from about 400 to about 600 mL.

Pulps produced according to the present invention may have one or more improved physical properties that make them well suited for use in the manufacture of wet-laid paper products and more particularly wet-laid tissue products. The inventive pulps may be blended with other wood and non-wood pulps as needed to form wet-laid products having the desired attributes. The blended pulps may comprise wood pulp fibers that have been produced by any one of several well-known methods such as chemical (sulfite, kraft), thermal, mechanical, or a combination of these techniques. In certain instances, the inventive pulps may replace one or more pulps, particularly wood pulps, in a conventional papermaking furnish. For example, the inventive pulps may replace bleached softwood kraft pulp fibers.

In certain embodiments the present invention provides a non-wood pulp, particularly a pulp comprising fibers derived from one or more species of *Hesperaloe*, prepared by mechanical pulping as described herein, having a fiber length of at least about 1.50 mm, and more preferably at least about 1.75 mm and still more preferably at least about 1.80 mm, such as from about 1.50 to about 2.20 mm. At the foregoing fiber lengths, the pulps may have a very long fiber fraction less than about 0.25%, more preferably less than about 0.20% and still more preferably less than about 0.15%.

In other embodiments the non-wood pulp has a relatively low degree of fines and high freeness, such as a fines content of less than about 2.0%, more preferably less than about 1.5% and still more preferably less than about 1.0%, such as from about 0.5 to about 2.0%. In addition to having a low content of fines, the non-wood pulp may have a freeness of about 400 mL or greater, such as about 450 mL or greater, such as about 500 mL or greater.

In yet other embodiments, the present invention provides a non-wood pulp having brightness of at least 80% or more, such as about 81% or more, such as about 82% or more, such as from about 80 to about 90%, such as from about 80 to about 85%. At the foregoing brightness levels the pulp may have a debris content of about 1.0 wt % or less, such as about 0.90 wt % or less, such as about 0.80 wt % or less, such as from about 0 to about 0.80 wt %.

In still other embodiments the present invention provides a non-wood pulp comprising less than about 5.0 wt % water soluble extractives, more preferably less than about 3.0 wt % water soluble extractives and still more preferably less than about 2.0 wt % water soluble extractives. The removal of water soluble extractives during processing of the non-wood biomass into pulp may improve the bleaching of the fiber such that the bleached non-wood pulp has both a low amount of water soluble extractives, as less than about 5.0 wt %, and a high degree of brightness, such as a brightness of at least 80% or more, such as about 81% or more, such as about 82% or more, such as from about 80 to about 92%, such as from about 80 to about 90%, such as from about 80 to about 85%.

In other embodiments the present invention provides a non-wood pulp having a high porosity, particularly a high porosity at a relatively high tensile index. For example, pulps prepared according to the present invention may have a tensile index from about 20 to about 50 and a porosity of about 100 cfm or greater, such as a porosity from about 100 to about 450 cfm.

Figure 6A:
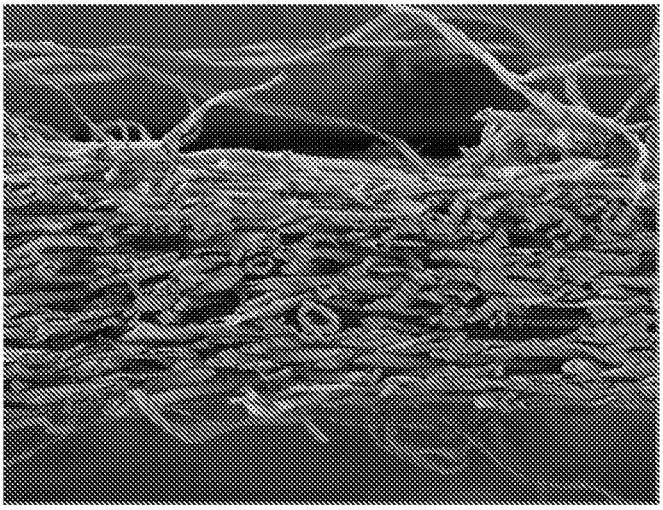
FIGS. 6A and 6B are scanning electron microscope (SEM) images taken at a magnification of 500×.
Figure 6B:
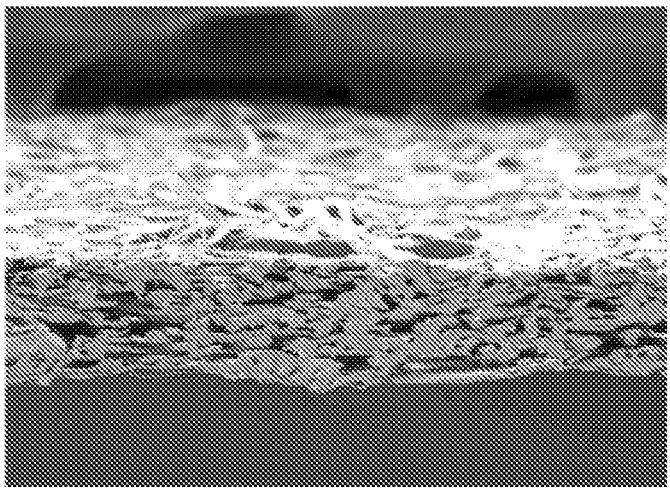

The improvement in porosity generally observed in pulps prepared according to the present invention, particularly unbleached pulps, may be attributable to the cross-section shape of the pulp fiber. For example, as illustrated in the scanning electron microscope (SEM) image shown in FIG. 6A the inventive unbleached fibers have a circular cross-section shape with open, un-collapsed, lumens. The shape of the fibers causes the sheet to have a significant amount of void space that facilitates the passage of air through the sheet. On the other hand, bleached fibers of the present invention, such as shown in FIG. 6B, have a flatter, more rectangular cross-section, with fewer open, un-collapsed lumens. These fibers form a denser sheet having improved fiber-fiber bonding and increased tensile strength, but lower porosity.

Test Methods

Pulp Handsheets

Handsheets of pulp were prepared using a Valley Ironwork lab handsheet former measuring 8.5 inches×8.5 inches. The pulp was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets having a basis weight of 60 grams per square meter (gsm) were formed using the wet laying handsheet former. Handsheets were couched off the screen, placed in the press with blotter sheets, and pressed at a pressure of 75 pounds per square inch for one minute, dried over a steam dryer for two minutes, and finally dried in an oven. The handsheets were cut to 7.5 inches square and subject to testing.

Fiber Properties

Fiber properties such as length, coarseness, percentage of fines, and fraction of very long fiber, are generally determined using an OpTest Fiber Quality Analyzer-360 (OpTest Equipment, Inc., Hawkesbury, ON) in accordance with the manufacturer's instructions. Samples are generally prepared by first accurately weighing a pulp sample. The sample mass may range from about 10 to about 50 mg (bone dry) and may be taken from a handsheet or pulp sheet. The weighed sample is diluted to a known consistency (between about 2 and about 10 mg/I). An aliquot of the diluted sample (usually 200 ml) is further diluted to a final volume of 600 ml and placed in the analyzer. The sample is then analyzed according to the manufacturer's instructions and the output of the analyzer, such as the length weighted average fiber length, coarseness, length weighted fines, and a histogram illustrating the distribution of various fiber properties for a given sample are recorded. Generally, each reported fiber property is the average of three replicates.

The output of the fiber quality analyzer is used to calculate the Very Long Fiber (VLF) fraction, which is the sum of fiber count from 6 to 14.95 mm divided by the total fiber count. Generally, the bin data output by the instrument, which provides the number of individual fibers counted within a given fiber length range, is used to determine VLF. The total number of individual fibers counted (N) and the total number of individual fibers counted having a length of 6 mm or greater (n) are determined from the bin data. The % VLF=n/N*100.

The output of the fiber quality analyzer is also used to calculate the ratio of the length weighted average fiber length ($L_w$) to the number average fiber length ($L_n$). $L_w$ and $L_n$ are calculated by the FQA software using the following equations:

$$L_w = \frac{\sum_{All\ Fibers} n_i L_i^2}{\sum_{All\ Fibers} n_i L_i} \quad L_n = \frac{\sum_{All\ Fibers} n_i L_i}{\sum_{All\ Fibers} n_i}$$

Where n and L are determined by the instrument in the course of analyzing a sample. The ratio of the length weighted average fiber length ($L_w$) to the number average fiber length ($L_n$) indicates the fiber length distribution of the sample. A higher ratio is indicative of a broader fiber length distribution. A value of 1 indicates that all of the fibers in the sample have the same length.

Fiber coarseness is measured using the FQA instrument and is measured "as-is" without removal of fines. Consistency of the pulp sample is determined using TAPPI methods T-240 or the equivalent and the consistency (%) is recorded to the nearest 0.01%. Based upon the measured consistency, the amount of undried sample required to yield approximately 0.015 grams of oven dried pulp is calculated and weighed out and the weight recorded to the nearest 0.0001 g. The weighed undried pulp is transferred to a British pulp disintegrator or equivalent pulp disintegrator and the total volume of the sample is diluted to 2 liters with deionized water and disintegrated for 15,000 revolutions according to the manufacturer's instructions. The disintegrated sample is further diluted with deionized water to a total volume of 5 liters±50 mL and the volume is recorded to the nearest 10 mL. The diluted sample is agitated by stirring and approximately 600 grams are weighted out into a clean beaker. The mass of the sample weighed out to the beaker is recorded to the nearest 0.1 g. The oven dried weight of the pulp sample to be analyzed is then calculated as shown in the equation below and fiber analysis is carried out according to the manufacturer's instructions.

$$O.D.\ \text{Mass of Pulp (g)} = \frac{\text{Undried Pulp (g)} \times \text{Consistency of undried sample (\%)} \times \text{Mass of Sample (g)}}{\text{Diluted Sample Volume (mL)} \times 10}$$

Caliper

Generally, hand sheets are dried and prepared for testing as set forth in TAPPI T 205 sp-02. Pulp sheets may be tested as is. Caliper is measured using an L & W Model code SE 050 Micrometer or equivalent. The micrometer has a circular pressure foot having an area of 2.0 $cm^2$, a lowering speed of 1.0 mm/second and a pressure of 50 kPa. Generally, caliper is reported as the average of five samples.

Basis Weight

Generally, hand sheets are dried and prepared for testing as set forth in TAPPI T 205 sp-02. Pulp sheets may be tested as is. The bone dry basis weight is generally measured by first cutting the samples to a specimen size of approximately 19.05×19.05 cm using an appropriate cutting tool. The cut sample is then placed on a balance in an oven preheated to 105±2° C. Once the weight of the sample has stabilized, the weight is recorded to the nearest 0.01 gram. The bone dry basis weight equals the measured weight (W) multiplied by 27.56.

Porosity

Porosity is measured using a Textest FX 3300 Air Permeability instrument (Textest AG, Schwerzenbach, Switzerland) according to the manufacturer's instructions. Generally, Porosity is measured by forming a handsheet of a particular pulp, as described herein, and then testing the resulting handsheet. When measuring the porosity of handsheets the test pressure is 2,500 Pa and the test head size is 38 $cm^2$. Tests are performed under TAPPI conditions (50±2% relative humidity and 72±1.8° F.) and samples are preconditioned overnight prior to testing. The test sample size is preferably at least 19.05×19.05 cm.

Tensile

Generally Tensile is measured by forming a handsheet of a particular pulp, as described herein, and then testing the resulting handsheet. Generally, handsheets are dried and prepared for testing as set forth in TAPPI T 205 sp-02. Samples are preconditioned and tested under TAPPI conditions (50±2% relative humidity and 72±1.8° F.) as set forth in TAPPI T 402. Tensile testing is carried out substantially as described in TAPPI T 494 om-01 using an MTS Systems Sintech 11S, Serial No. 6233 tensile testing instrument. The data acquisition software was an MTS TestWorks® for Windows Ver. 3.10 (MTS Systems Corp., Research Triangle Park, NC). Generally, the tensile strengths of five samples are measured and averaged. Tensile strength generally has units of grams force per unit sample width, such as g/25.4 mm.

Debris

Debris is generally measured using a MasterScreen™ from Pulmac Systems International (Williston, VT). The MasterScreen™ is a low consistency screening device designed to mechanically separate fibers from contaminants. The MasterScreen™ is fitted with a screen (part no. 3390P) having a slot size of 100 μm (0.004 inches). Screening of pulps using a MasterScreen type instrument is generally described in T-274.

Approximately 5.0 bone dry grams of fiber are used for the analysis. The sample may be taken from a handsheet, a pulpsheet or from wet lap pulp. The 5.0 g sample is mixed with 2 L of water and disintegrate using a benchtop disintegrator at 15,000 Revolution prior to testing. In certain instances where the sample is known to have a fiber length in excess of 2 mm, a cationic debonder such as cationic oleylimidazoline may be added to the diluted sample to prevent the formation of clumps or strings. In those instances where a debonder is added, it is typically added at 160 kilograms of debonder per bone dry metric ton of fiber. The sample is screened according to the manufacturer's instructions and the rejects are collected in a collection cup fitted with a 150 mesh stainless steel screen. A wash cycle is run after the initial cycle to ensure that all of the debris retained by the screen is captured. Finally, the collection cup is rinsed with water and the rinse fluid is collected in a beaker. The rejects and wash fluid collected in the beaker is filtered under vacuum using a pre-weighed filter pad. Debris is collected on the filter pad, which is dried in an oven preheated to 105° C. overnight. The dried filter pad is weighed to the nearest 0.01 g and the weight percentage of debris is calculated. Generally, debris is reported as wt % and is the average of three samples.

Water Soluble Solids

Total biomass water soluble solids may be determined using an Accelerated Solvent Extraction system (ASE) such as a Dionex™ ASE™ 350 (Thermo Fisher Scientific, Waltham, MA). Approximately grams of harvested biomass is dried to a constant weight in an oven, typically 4 hours at 125° C. After drying, approximately 0.2 grams of the bone dry biomass is accurately weighed, and the weight ($W_b$) recorded to the nearest 0.001 gram. Using water as the solvent, biomass is extracted using the conditions set forth in Table 3, below. The ratio of biomass to solvent is generally 100:1 and two consecutive water extraction cycles are performed.

TABLE 3

| | |
|---|---|
| Pressure (psi) | 1500 |
| Temperature (° C.) | 40 |
| Static Time (min.) | 5 |
| Cycles (no.) | 2 |

At the end of the extraction process the liquid phase is collected, dried under vacuum at approximately 80° C. in a warm water bath and the weight of the dried material ($W_i$) is recorded to the nearest 0.001 g. The total weight of water soluble solids ($W_e$) is calculated by the weight of solids recovered from the extraction process ($W_i$). Total water soluble solids as a percentage of bone dry biomass is then determined using the following equation:

$$\text{Water Soluble Solids } (wt\ \%) = \frac{W_e}{W_b} \times 100$$

Size Classification

The relative size of biomass and bagasse, as well as the nominal size, was determined using Williams screen analysis, using a TMI Chip Class™ Model 71-01 (Testing Machines Inc., New Castle, DE) substantially as described in TAPPI Useful Method 21, which indicates, by weight percentage, the relative proportion of biomass or bagasse retained on each of a series of screens having of varying size as set forth in Table 4, below.

TABLE 4

| Screen | Size Opening | |
|---|---|---|
| No. | Inch | mm |
| 1 | 1 | 25.4 |
| 2 | ¾ | 19.1 |
| 3 | ⅝ | 15.9 |
| 4 | ½ | 12.7 |
| 5 | ¼ | 6.4 |
| 6 | ⅛ | 3.2 |
| Pan | — | — |

The Williams screen analysis measures either the longitudinal or transverse dimensions of biomass or bagasse retained on a given screen. Two important values with regard to chip uniformity can be obtained from the above screen fraction data. The first value is the screen size through which at least 70% of the biomass or bagasse passes through, i.e, the nominal size. The second is the relative distribution of chips on each of the screens and the relative position of the screen at which the distribution is maximized.

EXAMPLES

Inventive Examples 1-7

Inventive pulps were prepared from *H. Funifera* biomass using an alkaline peroxide mechanical process. Both bleached and unbleached pulps were prepared. The processes used to prepare exemplary pulps is summarized in Table 5, below.

TABLE 5

| Example | Cut | Water Soluble Solids Extracted | Treated to Reduce Debris | Bleached |
|---|---|---|---|---|
| 1 | N | N | N | N |
| 2 | N | N | Y | Y |
| 3 | Y, harvester | Y | Y | Y |
| 4 | Y, mechanical chipper | N | Y | Y |
| 5 | N | Y | Y | N |
| 6 | N | Y | Y | N |
| 7 | N | N | Y | Y |

In certain instances, the biomass was cut to size prior to pulping. For example, the biomass was cut to size using a harvester equipped with a cutting head designed to cut the biomass to a nominal length of about mm (Example 3). In other instances, the length of the harvested biomass, having a nominal length of about 150 mm, was reduced using a mechanical chipper to a nominal size of about 6.5 mm (Example 4).

In certain instances, the harvested biomass was pressed and washed to remove water soluble extractives prior to pulping (Examples 3, 5 and 6). In those instances where the biomass was extracted prior to pulping, it was passed through a tandem mill while washing with water and/or imbibing with the extracted juice. Generally, about 40% of the water soluble extractives are removed by pressing and washing the biomass prior to pulping.

In all instances the biomass was washed by mixing with water, dewatered and then pressed using an Andritz 560 Impressafiner at a compression ratio of 2:1. The dewatered and pressed biomass had a consistency from about 40 to about 45%.

The dewatered and pressed biomass was fed to a pressurized high consistency refiner using a feed screw and blower. An impregnation solution (2% hydrogen peroxide, 2% sodium hydroxide, 1% sodium silicate and 0.4% DTPA) was added at the blower to allow an approximately 30-minute retention time before high consistency refining.

The impregnated biomass was fiberized in an Andritz 36-1 CP pressurized single disc refiner operating at a pressure of 30-35 psi and rotational disc speed of 1800 rpm. The refining consistency ranged from 25 to 45%.

After high consistency refining the pulp was blown to a cyclone and discharged. Blowline bleaching was carried out by the addition of a bleaching solution comprising 3% hydrogen peroxide, 1.2% sodium hydroxide, 3% sodium silicate and 0.4% DTPA at the entrance of the blowline. The retention time was approximately 1 hour.

In certain instances, after blowline bleaching, the pulp was diluted with water to a consistency of 2% and the pH was adjusted to 7.0 with the addition of sulfuric acid. The diluted pulp was passed through a pressure screen. The pressure screen has a Dolphin rotor design equipped with a PG25-03 micro-slotted screen basket having 0.1 mm slots. The screen fractioned the pulp into accepts and rejects. The rejects were sent to a twin-flow low consistency refiner for further processing. After low consistency refining, the refined pulp was combined with screening accepts and dewatered to a consistency of 20%.

In certain instances, pulp was subjected to two stage bleaching using an alkaline peroxide bleaching solution. Bleaching was generally carried out at a consistency of about 25%. The bleached pulp was washed, the pH was adjusted to about 7.0, diluted to a consistency of about 4.0% and refined.

The fiber and tensile strength properties of the primary and bleached pulp are summarized in Tables 6 and 7, below.

TABLE 6

| | Example | | | | | | |
|---|---|---|---|---|---|---|---|
| | 1 | 2 | 3 | 4 | 5 | 6 | 7 |
| Brightness (%) | 50.9 | 78.4 | 82.2 | 77.8 | 64.8 | 80.1 | 78.53 |
| Fiber Length (mm) | 2.58 | 2.73 | 1.75 | 2.09 | 1.87 | 1.97 | 2.73 |
| Coarseness (mg/100 m) | NA | NA | 4.50 | 5.53 | 6.80 | 5.70 | NA |
| Fines (%) | 2.40 | 0.90 | 1.30 | 0.8 | 2.20 | 1.80 | 1.1 |
| Water Retention Value (%) | 1.96 | 1.93 | 1.98 | 2.13 | 1.73 | 2.02 | 2.29 |

TABLE 7

| | Example | | | |
|---|---|---|---|---|
| | 2 | 3 | 4 | 7 |
| Dispersivity Index | 1.72 | 1.71 | 1.59 | 1.71 |
| Very Long Fiber (%) | 0.56 | 0.05 | 0.08 | 0..54 |
| Freeness (mL) | — | 604 | 576 | 529 |

To further assess the physical properties of the inventive pulps, samples were subjected to varying degrees of refining and formed into handsheets as described herein. The handsheets were subjected to tensile and porosity testing as described herein. The results of the tensile and porosity testing are summarized in Table 8, below.

TABLE 8

| | EXAMPLE | | | | | | | |
|---|---|---|---|---|---|---|---|---|
| | 1 | | 2 | | 3 | | 5 | |
| PFI Refining | Tensile Index | Porosity (cfm) | Tensile Index | Porosity (cfm) | Tensile Index | Porosity (cfm) | Tensile Index | Porosity (cfm) |
| Rev 100 | 30.92 | 203.2 | 54.33 | 85.4 | 40.35 | 137.8 | 27.66 | 437.8 |
| Rev 500 | 38.37 | 118 | 66.39 | 58.36 | 45.23 | 101.8 | 31.1 | 365 |
| Rev 1000 | 47.61 | 79.9 | 70.91 | 32.18 | 49.01 | 85.38 | 35.29 | 317.2 |
| Rev 2000 | 47.25 | 51.88 | 76.53 | 12.8 | 66.64 | 36.96 | 36.83 | 246.2 |

Inventive Examples 8-9

Additional inventive pulps were prepared from *H. Funifera* biomass using an alkaline peroxide mechanical process. The processes used to prepare exemplary pulps is summarized in Table 9, below.

TABLE 9

| Example | Cut | Water Soluble Solids Extracted | Treated to Reduce Debris | Bleached |
|---|---|---|---|---|
| 8 | Y, harvester | Y | Y | Y |
| 9 | Y, mechanical cutting and screening | Y | Y | Y |

Biomass for Example 8 was cut to size using a harvester equipped with a cutting head designed to cut the biomass to a nominal length of about 10 mm. The harvested biomass was then passed through a tandem mill while washing with water and/or imbibing with the extracted juice to remove a portion of the water soluble solids. Generally, about 40% of the water soluble extractives were removed by pressing and washing the biomass prior to pulping.

To further cut the biomass, the pressed biomass diluted with water to a consistency of about 15% was fed to an Andritz 560 Impressafiner having a compression ratio of 2:1. The cut and pressed biomass had a consistency from about 50%. The cut and pressed biomass was subsequently washed, hydrosieved, and passed through an Andritz 560 Impressafiner having a compression ratio of 2:1 a second time to yield a bagasse. The size distribution of the resulting bagasse is summarized in Table 10, below.

Biomass for Example 9 was cut to size using a harvester equipped with a cutting head designed to cut the biomass to a nominal length of about 10 mm. The harvested biomass was subjected to cutting using a rotary knife and screening the cut biomass with a ¾" screen. The cut biomass was then diluted with water to a consistency of about 40% and fed to an Andritz 560 Impressafiner having a compression ratio of 2:1 to extract a portion of the water soluble solids prior to pulping. The extracted biomass was subsequently washed, hydrosieved, and passed through an Andritz 560 Impressafiner having a compression ratio of 2:1 a second time to yield a bagasse. The size distribution of the resulting bagasse is summarized in Table 10, below.

TABLE 10

| Screen Size | | Example 8 Accumulated | Example 9 Accumulated |
|---|---|---|---|
| inch | mm | Mass % | Mass % |
| 1 | 25.4 | 0% | 0% |
| ¾ | 19.1 | 1% | 1% |

TABLE 10-continued

| Screen Size | | Example 8 Accumulated | Example 9 Accumulated |
|---|---|---|---|
| inch | mm | Mass % | Mass % |
| ⅝ | 15.9 | 8% | 7% |
| ½ | 12.7 | 26% | 15% |
| ¼ | 6.4 | 81% | 69% |
| ⅛ | 3.2 | 94% | 90% |

The bagasse was fed to a pressurized high consistency refiner using a feed screw and blower. An impregnation solution (2% hydrogen peroxide, 1.5% sodium hydroxide, 1% sodium silicate and 0.1% DTPA) was added at the blower to allow at least 30 min retention time before high consistency refining.

The impregnated biomass was fiberized in an Andritz 36-1 CP pressurized single disc refiner operating at a pressure of 30-35 psi and rotational disc speed of 1800 rpm. The refining consistency ranged from 25 to 45%.

After high consistency refining the pulp was blown to a cyclone and discharged. Blowline bleaching was carried out by the addition of a bleaching solution comprising 3% hydrogen peroxide, 2% sodium hydroxide, 2% sodium silicate and 0.2% DTPA at the entrance of the blowline, The retention time was no less, than 1 hour.

The primary pulp was subjected to a twinflo low consistency refining at a feed consistency of 4.25% before a single stage bleaching using an alkaline peroxide bleaching solution. Bleaching was generally carried out at a consistency of about 20%-25%. The bleached pulp was diluted, the pH was adjusted to about 7.0, thickened and cleaned by a serious of equipment such as pressure screen, hydrocyclone cleaners, micra screen and twin-wire press. The fiber and tensile strength properties of the bleached pulp are summarized in the Tables 11 and 12, below.

TABLE 11

| | Example 8 | Example 9 |
|---|---|---|
| Brightness | 68 | 76 |
| Fiber Length, mm | 1.688 | 1.873 |
| Coarseness (mg/100 m) | 4.83 | 4.80 |
| Fines (%) | 3.1 | 2.2 |

TABLE 12

| | Example 8 | Example 9 |
|---|---|---|
| Dispersivity Index | 2.01 | 1.91 |
| Very Long Fiber (%) | 0.05% | 0.06% |
| Freeness (Rev 0), CSF ml | 393 | 458 |

To further assess the physical properties of the inventive pulps, samples were subjected to varying degrees of refining and formed into handsheets as described herein. The handsheets were subjected to tensile and porosity testing as described herein. The results of the tensile and porosity testing are summarized in Table 13, below.

TABLE 13

| | Example 8 | | Example 9 | |
|---|---|---|---|---|
| PFI Refining | Tensile Index | Porosity (cfm) | Tensile Index | Porosity (cfm) |
| Rev 0 | 45.13 | 18.76 | 50.1 | 44.64 |
| Rev 100 | 50.24 | 13.74 | 72.71 | 26.03 |
| Rev 500 | 54.21 | 6.22 | 53.37 | 14.06 |

Comparative Example 1

A comparative sample of *H. Funifera* pulp was prepared using a conventional soda-anthraquinone pulping process. *H. Funifera* biomass was treated with sodium hydroxide (20% by weight of the oven dry biomass) and anthraquinone (0.3% by weight to the dry weight of oven dry biomass) at a liquid to dry fiber ratio of about 7 (consistency of about 12.5%), at a maximum temperature of about 175° C. for 35 or 40 minutes. The resulting pulp was washed and cleaned but was not bleached. The fiber and tensile strength properties of the unbleached pulp are summarized in Table 14, below.

TABLE 14

| Short Description | Unbleached Soda AQ | |
|---|---|---|
| Brightness (%) | 35 | |
| Fiber Length (mm) | 2.86 | |
| Coarseness (mg/100 m) | 6.4 | |
| Fines (%) | 2.2 | |
| Water Retention Value (%) | 2.43 | |
| PFI Refining | Tensile Index | Porosity (cfm) |
| Rev 100 | 67 | 37 |
| Rev 500 | 69 | 39 |
| Rev 1000 | 75 | 19 |
| Rev 2000 | 82 | 12 |

Comparative Example 2

A comparative sample of *H. Funifera* pulp was prepared using a chemi-mechanical pulping process utilizing an acid catalyzed hydrolysis of the biomass with mechanical defibrillation substantially as described in U.S. Pat. No. 7,396,434. The pulp was washed and cleaned but was not bleached. The fiber and tensile strength properties of the unbleached pulp are summarized in Table 15, below.

TABLE 15

| Short Description | Unbleached Chemi-Mechanical Non-Wood |
|---|---|
| Brightness (%) | 55 |
| Fiber Length (mm) | 1.45 |
| Coarseness (mg/100 m) | 5.1 |
| Fines (%) | 4.3 |
| Water Retention Value (%) | 1.77 |

TABLE 15-continued

| PFI Refining | Tensile Index | Porosity (cfm) |
|---|---|---|
| Rev 100 | 22 | 30 |
| Rev 500 | 24 | 23 |
| Rev 1000 | 29 | 12 |
| Rev 2000 | 30 | 7 |

Comparative Examples 3 and 4

A comparative sample of *H. Funifera* pulp was prepared using a three stage non-wood pulping process commercially available from Taizen America (Macon, GA). The pulping process involved both mechanical action and chemical treatment to defibrillate the biomass and produce pulp. Generally, *H. Funifera* biomass was cut to a nominal size of about 20 mm using a guillotine style cutter. The cut biomass was conveyed to a mechanical masher and diluted with water to a consistency of about 40%. The mashed biomass was conveyed to a kneader and the consistency was adjusted to about 30%. The mashed biomass was mechanically pulped using the kneader with the addition of 7% NaOH to the first kneading cylinder and 5% $H_2O_2$ to the second kneading cylinder. The resulting pulp was washed and screened. A portion of the pulp was bleached using an alkaline peroxide solution. The fiber and tensile strength properties of the unbleached and bleached pulps are summarized in Table 16, below.

TABLE 16

| Short Description | Bleached Mechanical Non-Wood Pulp | | Unbleached Mechanical Non-Wood Pulp | |
|---|---|---|---|---|
| Brightness *%) | 82 | | 40 | |
| Fiber Length (mm) | 1.89 | | 2.34 | |
| Very Long Fiber (%) | 0.09 | | — | |
| Dispersivity Index | 1.97 | | — | |
| Fines (%) | 4.4 | | 1.9 | |
| Water Retention Value (%) | 1.40 | | 2.08 | |
| PFI Refining | Tensile Index | Porosity (cfm) | Tensile Index | Porosity (cfm) |
| Rev 100 | 32 | 70 | 36 | 72 |
| Rev 500 | 43 | 41 | 39 | 43 |
| Rev 1000 | 46 | 27 | 40 | 45 |
| Rev 2000 | 55 | 10 | — | — |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments:

Embodiment 1: A non-wood pulp comprising a plurality of fibers derived from a plant of the family Asparagaceae, the pulp having a fiber length greater than about 1.70 mm and a Very Long Fiber content of about 0.50% or less Embodiment 2: The non-wood pulp of embodiment 1 comprising 1% or less of debris and more preferably 0.6% or less.

Embodiment 3: The non-wood pulp of embodiment 1 or 2 having a fiber length from about 1.70 to about 2.50 mm, a coarseness from about 4.0 to about 10.0 mg/100 m and a porosity from about 100 to about 450 cfm.

Embodiment 4: The non-wood pulp of any one of the preceding embodiments having a Tensile Index of at least about 20 Nm/g and a porosity from about 100 to about 450 cfm.

Embodiment 5: The non-wood pulp of any one of the preceding embodiments wherein the plurality of fibers are derived from one or more plants of the genus *Hesperaloe*.

Embodiment 6: The non-wood pulp of any one of the preceding wherein the one or more plants are selected from *H. funifera, H. parviflora, H. nocturne, H. chiangii, H. tenuifolia, H. engelmannii* and *H. malacophylla*.

Embodiment 7: The non-wood pulp of any one of the preceding embodiments having a Freeness from about 400 to about 600 mL.

Embodiment 8: The non-wood pulp of any one of the preceding embodiments having a fines content of less than about 2.0% and a Freeness of about 400 mL or greater.

Embodiment 9: The non-wood pulp of any one of the preceding embodiments having a dispersivity index or about 2.00 or less, such as from about 1.50 to about 2.00.

Embodiment 10: The non-wood pulp of any one of the preceding embodiments having a brightness of about 80% or greater, such as from about 80 to about 92%.

Embodiment 11: The non-wood pulp of any one of the preceding embodiments, wherein the pulp is a produced by a chemi-mechanical process.

Embodiment 12: The non-wood pulp of any one of the preceding embodiments, wherein the non-wood pulp is bleached without the use of element chlorine.

Embodiment 13: The non-wood pulp of any one of the preceding embodiments wherein the pulp is a substantially dry sheet having a moisture content of about 10% or less and a sheet bulk of at least about 2.0 cc/g.

Embodiment 14: A method of manufacturing a non-wood pulp comprising the steps of: (a) harvesting a non-wood biomass derived from a plant of the family Asparagaceae to yield a harvested biomass having a first nominal size; (b) cutting the harvested biomass to a cut biomass having a second nominal length; (c) extracting water soluble solids from the cut biomass; (d) impregnating the extracted biomass with a first alkaline peroxide solution and maintaining the impregnation for a first reaction time to produce an impregnated bagasse; (e) refining the impregnated bagasse under first refining conditions to produce a primary pulp; (f) cleaning the primary pulp to produce a cleaned pulp comprising less than about 5 wt %, by dry weight of the pulp, debris; and (g) adding a second alkaline peroxide solution to the cleaned pulp to produce a bleached pulp.

Embodiment 15: The method of embodiment 14 wherein where the second nominal size is about 20 mm or less and the second nominal size is less than the first nominal size.

Embodiment 16: The method of embodiment 14 or 15 further comprising the step of compressing the extracted biomass at a consistency of at least about 40% prior to impregnating the extracted biomass with a first alkaline peroxide solution.

Embodiment 17: The method of any one of embodiments 14-16 wherein the step of refining comprises feeding the impregnated bagasse into a refiner having an inlet and a rotating disc within a superatmospheric casing and maintaining the superatmospheric casing at a pressure of at least about 240 kP.

Embodiment 18: The method of any one of embodiments 14-17 wherein the impregnated bagasse has a consistency from about 20 to about 60%.

Embodiment 19: The method of any one of embodiments 14-18 further comprising the steps of delivering the primary pulp through a blow valve to a blow line and adding a sodium hydroxide alkaline peroxide solution to the stream of primary pulp in the blow line.

Embodiment 20: The method of any one of embodiments 14-19 the primary pulp temperature is at least about 80° C.

We claim:

1. A non-wood pulp comprising a plurality of fibers derived from a plant of the family Asparagaceae, the pulp having a Freeness from about 400 to about 600 mL, a fiber length from about 1.70 to about 2.50 mm and a Very Long Fiber content of about 0.50% or less.

2. The non-wood pulp of claim 1 having a Dispersivity Index of about 2.0 or less.

3. The non-wood pulp of claim 1 having a Dispersivity Index from about 1.50 to about 2.00.

4. The non-wood pulp of claim 1 having a Very Long Fiber content of about 0.25% or less.

5. The non-wood pulp of claim 1 having a coarseness less than about 10.0 mg/100 m.

6. The non-wood pulp of claim 1 having a Dispersivity Index from about 1.50 to about 1.80 and a coarseness from about 4.0 to about 10.0 mg/100 m.

7. The non-wood pulp of claim 1 wherein the plurality of fibers are derived from a plant of the genus *Hesperaloe*.

8. The non-wood pulp of claim 7 wherein the plurality of fibers are derived from one or more plants selected from *H. funifera, H. parviflora, H. nocturna, H. chiangii, H. tenuifolia, H. engelmannii* and *H. malacophylla*.

9. The non-wood pulp of claim 1 having a Fines content of less than about 2.0% and a Freeness of about 400 mL or greater.

10. The non-wood pulp of claim 1 having a Brightness of at least about 80%.

11. The non-wood pulp of claim 1 having a Brightness from about 80 to about 92%.

12. A bleached, chemi-mechanical, non-wood pulp comprising a plurality of bleached, chemi-mechanical pulped fibers derived from one or more plants selected from *H. funifera, H. parviflora, H. nocturna, H. chiangii, H. tenuifolia, H. engelmannii* and *H. malacophylla*, the pulp having a Freeness from about 400 to about 600 mL, a fiber length from about 1.70 to about 2.50 mm, a Dispersivity Index of about 2.00 or less and a coarseness from about 4.0 to about 10.0 mg/100 m.

13. The bleached, chemi-mechanical, non-wood pulp of claim 12 having a Very Long Fiber content of about 0.25% or less.

14. The bleached, chemi-mechanical, non-wood pulp of claim 12 having a Very Long Fiber content of about 0.10% or less.

15. The bleached, chemi-mechanical, non-wood pulp of claim 12 having a fines content of less than about 2.0%.

16. The bleached, chemi-mechanical, non-wood pulp of claim 12 having a Brightness from about 80 to about 92%.

* * * * *